US008733957B2

(12) United States Patent
Takahashi

(10) Patent No.: US 8,733,957 B2
(45) Date of Patent: May 27, 2014

(54) LIGHT EMITTING DEVICE, VEHICLE HEADLAMP, AND ILLUMINATION DEVICE

(75) Inventor: Koji Takahashi, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 381 days.

(21) Appl. No.: 13/280,572

(22) Filed: Oct. 25, 2011

(65) Prior Publication Data

US 2012/0106183 A1 May 3, 2012

(30) Foreign Application Priority Data

Oct. 29, 2010 (JP) ..... 2010-244574
Aug. 11, 2011 (JP) ..... 2011-176173

(51) Int. Cl.

| | |
|---|---|
| ***F21V 9/16*** | (2006.01) |
| ***F21S 8/10*** | (2006.01) |
| *F21S 8/12* | (2006.01) |
| *F21Y 101/02* | (2006.01) |

(52) U.S. Cl.

CPC ..... *F21S 48/119* (2013.01); *F21S 48/1195* (2013.01); *F21S 8/12* (2013.01); *F21Y 2101/025* (2013.01)

USPC ..... 362/84; 362/244; 362/259; 362/260; 362/516; 362/538

(58) Field of Classification Search

CPC ..... F21S 8/12; F21S 49/119; F21S 48/1145; F21S 48/1159; F21S 48/1195; F21S 48/1323; F21Y 2101/025

USPC ..... 362/84, 244, 259, 260, 516, 538

See application file for complete search history.

(56) References Cited

U.S. PATENT DOCUMENTS

| | | | | |
|---|---|---|---|---|
| 5,535,230 | A | 7/1996 | Abe | |
| 5,962,971 | A | 10/1999 | Chen | |
| 6,412,971 | B1 | 7/2002 | Wojnarowski et al. | |
| 7,131,759 | B2 * | 11/2006 | Ishida et al. | 362/84 |
| 7,144,131 | B2 | 12/2006 | Rains | |

(Continued)

FOREIGN PATENT DOCUMENTS

| | | |
|---|---|---|
| CN | 1676986 | 10/2005 |
| CN | 101629689 | 1/2010 |

(Continued)

OTHER PUBLICATIONS

Takahashi et al., U.S. Notice of Allowance mailed Nov. 20, 2013, directed to U.S. Appl. No. 13/284,487; 13 pages.

(Continued)

*Primary Examiner* — Stephen F Husar
(74) *Attorney, Agent, or Firm* — Morrison & Foerster LLP

(57) ABSTRACT

A headlamp includes an laser element for emitting a laser beam; a light emitting section for emitting fluorescence by receiving the laser beam emitted from the laser element; and a parabolic mirror for reflecting the fluorescence emitted from the light emitting section, the light emitting section being placed so that a focal point of the parabolic mirror and a periphery of the focal point are positioned on the light emitting section, the light emitting section being most strongly excited at a portion corresponding to the focal point, meanwhile, at a portion corresponding to the periphery of the focal point, the light emitting section being excited with intensity being dependent on light intensity distribution of the excitation light on an irradiation surface of the light emitting section.

20 Claims, 19 Drawing Sheets

(56) References Cited

U.S. PATENT DOCUMENTS

| | | | | |
|---|---|---|---|---|
| 7,165,871 | B2 | 1/2007 | Takeda et al. | |
| 7,168,837 | B2 | 1/2007 | Ishida et al. | |
| 7,232,247 | B2 | 6/2007 | Yatsuda et al. | |
| 7,282,748 | B2 | 10/2007 | Takeda et al. | |
| 7,382,091 | B2 | 6/2008 | Chen et al. | |
| 7,810,954 | B2 | 10/2010 | Kolodin | |
| 8,342,720 | B2 | 1/2013 | Harada et al. | |
| 8,348,458 | B2 | 1/2013 | Holten et al. | |
| 2002/0015308 | A1 | 2/2002 | Naganawa et al. | |
| 2004/0184279 | A1 | 9/2004 | Molto et al. | |
| 2005/0105301 | A1 | 5/2005 | Takeda et al. | |
| 2005/0157508 | A1 | 7/2005 | Takeda et al. | |
| 2005/0231971 | A1 | 10/2005 | Ishida | |
| 2006/0139926 | A1 | 6/2006 | Morioka et al. | |
| 2007/0080362 | A1 | 4/2007 | Scotch et al. | |
| 2008/0007961 | A1 | 1/2008 | Mochizuki et al. | |
| 2009/0046474 | A1 | 2/2009 | Sato et al. | |
| 2009/0231874 | A1 | 9/2009 | Kishimoto et al. | |
| 2010/0008099 | A1 | 1/2010 | Inoue et al. | |
| 2010/0102199 | A1 | 4/2010 | Negley et al. | |
| 2010/0128463 | A1* | 5/2010 | Kim et al. | 362/84 |
| 2010/0232173 | A1 | 9/2010 | Ohno et al. | |
| 2011/0215701 | A1 | 9/2011 | Tong et al. | |
| 2011/0248624 | A1 | 10/2011 | Kishimoto et al. | |
| 2011/0280031 | A1 | 11/2011 | Luger et al. | |
| 2012/0068630 | A1 | 3/2012 | Li et al. | |
| 2012/0104934 | A1 | 5/2012 | Fukai et al. | |
| 2012/0106188 | A1 | 5/2012 | Takahashi et al. | |
| 2012/0106189 | A1 | 5/2012 | Takahashi et al. | |
| 2012/0140504 | A1 | 6/2012 | Fukai et al. | |
| 2012/0224384 | A1 | 9/2012 | Takahira et al. | |
| 2013/0003403 | A1 | 1/2013 | Takahira et al. | |

FOREIGN PATENT DOCUMENTS

| | | |
|---|---|---|
| JP | 7-282609 | 10/1995 |
| JP | 7-318998 | 12/1995 |
| JP | 2002-87153 | 3/2002 |
| JP | 2003-295319 | 10/2003 |
| JP | 2004-231179 | 8/2004 |
| JP | 2004-241142 | 8/2004 |
| JP | 2005-150041 | 6/2005 |
| JP | 2005-205195 | 8/2005 |
| JP | 2006-210887 | 8/2006 |
| JP | 2006-253019 | 9/2006 |
| JP | 2007-30570 | 2/2007 |
| JP | 2007-142173 | 6/2007 |
| JP | 2008-13014 | 1/2008 |
| JP | 2009-9898 | 1/2009 |
| JP | 2009-48786 | 3/2009 |
| JP | 2009-513003 | 3/2009 |
| JP | 2009-67083 | 4/2009 |
| JP | 2009-96250 | 5/2009 |
| JP | 2009-129683 | 6/2009 |
| JP | 2009-266437 | 11/2009 |
| JP | 2009-302186 | 12/2009 |
| JP | 2010-86815 | 4/2010 |
| JP | 2010-140663 | 6/2010 |
| JP | 2010-153241 | 7/2010 |
| JP | 2010-212148 | 9/2010 |
| JP | 2010-212615 | 9/2010 |
| JP | 2010-232044 | 10/2010 |
| WO | WO-2010/116305 | 10/2010 |

OTHER PUBLICATIONS

Takahashi, K. et al. (2011) "'Laser headlight' for Next Generation Automotive Lighting," *9th International Symposium on Automotive Lighting* 271-283.

Takahashi et al., U.S. Office Action mailed Jun. 11, 2013, directed to U.S. Appl. No. 13/284,487; 13 pages.

Takahashi et al., U.S. Office Action mailed Aug. 8, 2013, directed to U.S. Appl. No. 13/284,523; 17 pages.

Takahashi et al., U.S. Notice of Allowance mailed Jan. 27, 2014, directed to U.S. Appl. No. 13/284,523; 8 pages.

Fukai et al., U.S. Office Action mailed Feb. 10, 2014, directed to U.S. Appl. No. 13/297,008; 12 pages.

* cited by examiner

LIGHT EMITTING DEVICE, VEHICLE HEADLAMP, AND ILLUMINATION DEVICE

This Nonprovisional application claims priority under 35 U.S.C. §119(a) on Patent Application No. 2010-244574 filed in Japan on Oct. 29, 2010, and Patent Application No. 2011-176173 filed in Japan on Aug. 11, 2011, the entire contents of which are hereby incorporated by reference.

TECHNICAL FIELD

The present invention relates to a light emitting device, a vehicle headlamp, and an illumination device, each of which can accomplish an arbitrary light-projection pattern.

BACKGROUND ART

In recent years, studies have been intensively carried out for such a light emitting device that generates incoherent illumination light by using an excitation light source for generating excitation light to irradiate a light emitting section including a fluorescent material, to thereby generate the incoherent illumination light. As the excitation light source, a semiconductor light emitting element is used, such as a light emitting diode (LED), a laser diode (LD), or the like.

As an example of techniques for such light emitting device, the patent literature 1 is disclosed.

The light source device of Patent Literature 1 includes a laser diode for emitting a laser beam of a short wavelength, a collimator for collimating this laser beam from the laser diode into a parallel luminous flux, a condenser for converging the laser beam of the parallel luminous flux from the collimator, and a fluorescent material absorbing the laser beam converged by the condenser and emitting incoherent light as natural emission light. Therefore, in the light source device of Patent Literature 1, the fluorescent material absorbs the laser beam which has large amount of light but serves as coherent light, and naturally emits the incoherent light.

CITATION LIST

Patent Literature 1

Japanese Patent Application Publication, Tokukai, No. 2003-295319 A (Publication Date: Oct. 15, 2003)

SUMMARY OF INVENTION

Technical Problem

However, the conventional technique has the following problem.

Specifically, in the light source device of Patent Literature 1, the fluorescent material positions substantially on a focal point of a reflection mirror and only the focal point is irradiated with a laser beam. That is, in the light source device of Patent Literature 1, a portion surrounding the portion which corresponds to the focal point is not irradiated with the laser beam and only the focal point is irradiated with the laser beam, so that light-projection is accomplished only under such a limited light-distribution state.

The present invention has been made in order to solve aforementioned problem, and an object of the present invention is to provide a light emitting device that can accomplish an arbitrary light-projection pattern, a vehicle headlamp, and an illumination device.

Solution to Problem

In order to attain the object, a light emitting device according to the present invention includes: an excitation light source for emitting excitation light; a light emitting section for emitting fluorescence by receiving the excitation light emitted from the excitation light source; and a light-projecting section for projecting the fluorescence emitted from the light emitting section, the light emitting section being placed so that a focal point of the light-projecting section and a periphery of the focal point are positioned on the light emitting section, the light emitting section being most strongly excited at a portion corresponding to the focal point, meanwhile, at a portion corresponding to the periphery of the focal point, the light emitting section being excited with intensity being dependent on light intensity distribution of the excitation light on an irradiation surface of the light emitting section.

According to this arrangement, the light emitting section is placed so that the focal point of the light-projecting section and the periphery of the focal point are positioned on the light emitting section. Further, the light emitting section is most strongly excited at a portion corresponding to the focal point, meanwhile, at a portion corresponding to the periphery of the focal point, the light emitting section is excited with intensity being dependent on light intensity distribution of the excitation light on an irradiation surface of the light emitting section.

The light emitting section is most strongly excited at a portion corresponding to the focal point as described above. The fluorescence emitted from the portion is projected from the light-projecting section, and hence the light emitting section according to the present invention can brightly illuminate a due forward direction of the light-projecting section with a narrow solid angle.

Further, at a portion corresponding to the periphery of the focal point, the light emitting section is excited with intensity being dependent on light intensity distribution of the excitation light on an irradiation surface of the light emitting section. The fluorescence emitted from the portion is projected from the light-projecting section, and therefore the light emitting section can appropriately illuminate the vicinity of the due forward direction of the light-projecting section with a wide solid angle. In addition, a light-projection pattern of a target to be illuminated with light can be arbitrarily changed by applying the light intensity distribution of the excitation light in accordance with a use for or a usage state of the light emitting device. That is, the light emitting device according to the present invention can solve the conventional problem that light-projection is accomplished only under such a limited light-distribution state that the portion corresponding to the periphery of the focal point is not irradiated with a laser beam and only the portion corresponding to the focal point is irradiated with the laser beam.

As described above, the light emitting device according to the present invention can accomplish an arbitrary light-projection pattern in accordance with a use for or a usage state of the light emitting device, and therefore the light emitting device can be much convenient for a user in comparison with conventional light emitting devices.

Advantageous Effects of Invention

As described above, a light emitting device according to the present invention includes: an excitation light source for emitting excitation light; a light emitting section for emitting fluorescence by receiving the excitation light emitted from the excitation light source; and a light-projecting section for projecting the fluorescence emitted from the light emitting section, the light emitting section being placed so that a focal point of the light-projecting section and a periphery of the focal point are positioned on the light emitting section, the light emitting section being most strongly excited at a portion corresponding to the focal point, meanwhile, at a portion corresponding to the periphery of the focal point, the light emitting section being excited with intensity being dependent on light intensity distribution of the excitation light on an irradiation surface of the light emitting section.

Therefore the present invention makes it possible to accomplish an arbitrary light-projection pattern.

DESCRIPTION OF EMBODIMENTS

A headlamp 1 etc. according to embodiments will be described below with reference to the drawings. Note that, although the headlamp will be mainly described below, this headlamp is merely an example of an illumination device to which the present invention is applicable, and hence, needless to say, the present invention is applicable to an arbitrary illumination device. In the following description, the like members or the like arrangements are denoted by the like reference signs, and in addition, also have the like names, and the like functions. Therefore, detailed description thereof will not be described repeatedly.

One embodiment of the present invention will be described below with reference to FIG. 1 etc.

[Arrangement of Headlamp 1]

Figure 1:
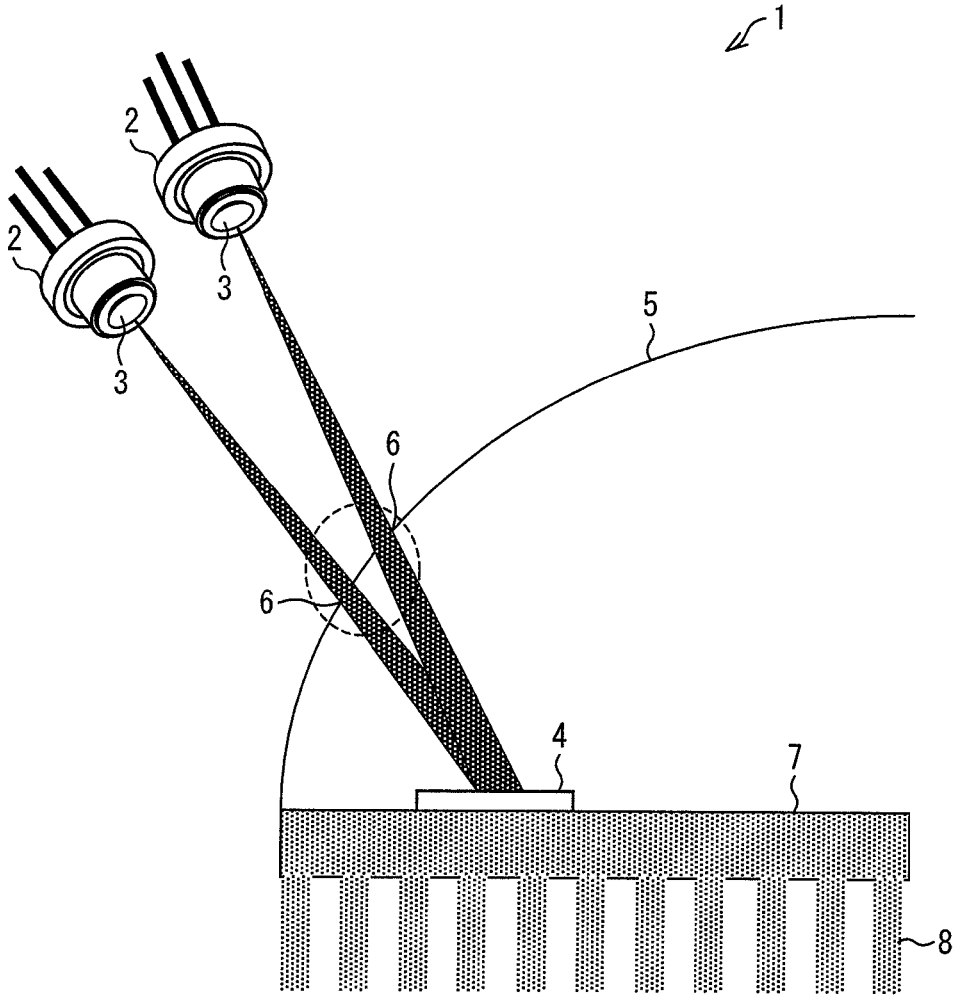
FIG. 1 is a cross sectional view illustrating a schematic arrangement of a headlamp (headlight) according to an embodiment of the present invention.

FIG. 1 is a cross sectional view illustrating a schematic arrangement of a headlamp (headlight) 1 according to an embodiment of the present invention. As illustrated in FIG. 1, the headlamp 1 includes a laser element (excitation light source, semiconductor laser) 2, a lens 3, a light emitting section 4, a parabolic mirror (reflection mirror) 5, a metal base 7, and a fin 8.

(Laser Element 2)

The laser element 2 is a light emitting element functioning as an excitation light source for emitting excitation light. Instead of one laser element 2, a plurality of laser elements 2 may be provided. In this case, each of the plurality of laser elements 2 emits a laser beam as excitation light. Only one laser element 2 may be used, however, the use of the plurality of laser elements 2 can easily provide a high-output laser beam.

The laser element 2 may include one light emitting point on one chip, and alternatively, may include a plurality of light emitting points on one chip. A wavelength of the laser beam from the laser element 2 is, for example, 405 nm (blue violet light) or 450 nm (blue light), but the wavelength of the laser beam is not limited thereto, and may be appropriately selected in accordance the kind of fluorescent material included in the light emitting section 4.

Further, as the excitation light source (light emitting element), a light emitting diode (LED) may be used instead of the laser element.

(Lens 3)

The lens 3 adjusts (for example, extends) irradiation range of a laser beam so that the light emitting section 4 is appropriately irradiated with the laser beam emitted from the laser element 2 The lens 3 is provided in each laser element 2.

(Light Emitting Section 4)

The light emitting section 4 emits fluorescence by receiving a laser beam emitted from the laser element 2 and includes a fluorescent material for radiating light by receiving a laser beam. Specifically, the light emitting section 4 may be prepared by dispersing a fluorescent material in a sealing material or solidifying a fluorescent material. The light emitting section 4 can be called a wavelength conversion element because the light emitting section 4 converts a laser beam into fluorescence.

The light emitting section 4 is placed on the metal base 7 so that a focal point of the parabolic mirror 5 and a periphery of the focal point are positioned on the light emitting section 4. An optical path of the fluorescence is controlled by reflecting on a reflecting curved-surface of the parabolic mirror 5 the fluorescence emitted from the light emitting section 4. Further, the light emitting section 4 is most strongly excited at a portion corresponding to the focal point of the parabolic mirror 5, meanwhile the light emitting section is excited with intensity being dependent on light intensity distribution of the laser beam on the irradiation surface of the light emitting section.

Examples of the fluorescent material of the light emitting section 4 encompass oxynitride fluorescent material (such as a sialon fluorescent material) or III-V compound semiconductor nanoparticle fluorescent material (such as indium phosphide: InP). These fluorescent materials each have high thermal tolerance against a high-output laser beam (and/or light density) emitted from the laser element 2, so that the fluorescent materials are quite suitable for a laser illumination light source. Note that a fluorescent material of the light emitting section 4 is not limited thereto, and other fluorescent materials may be used.

The law provides that white light of a headlamp has a predetermined range of chromaticity. Therefore the light emitting section 4 includes fluorescent material selected so that the light emitting section 4 emits the white light.

For example, the light emitting section 4 generates white light when the light emitting section 4 includes blue, green, and red fluorescent materials and is irradiated with a laser beam having a wavelength of 405 nm. Alternatively, the light emitting section 4 also generates white light when the light emitting section 4 includes a yellow fluorescent material (or alternatively, green and red fluorescent materials) and is irradiated with a laser beam having a wavelength of 450 nm (blue light) (or a laser beam having a wavelength close to the wavelength for blue light, i.e., a laser beam having a peak wavelength within a range from 440 to 490 nm).

The sealing material used for the light emitting section 4 may be, for example, a glass material (inorganic glass, organic or inorganic hybrid glass) or a resin material such as a silicone resin. As the glass material, a low-melting glass may be used. The sealing material is preferably a material having a high transmittance. In the case where a high-output laser beam is projected, a sealing material having a high heat resistance is preferably used.

(Parabolic Mirror 5)

The parabolic mirror 5 reflects fluorescence emitted from the light emitting section 4 so as to form a bundle of rays (illumination light) which travels within a predetermined solid angle. The parabolic mirror 5 may be, for example, a member having a surface on which a metal thin film is formed, or a member made of metal.

Figure 2:
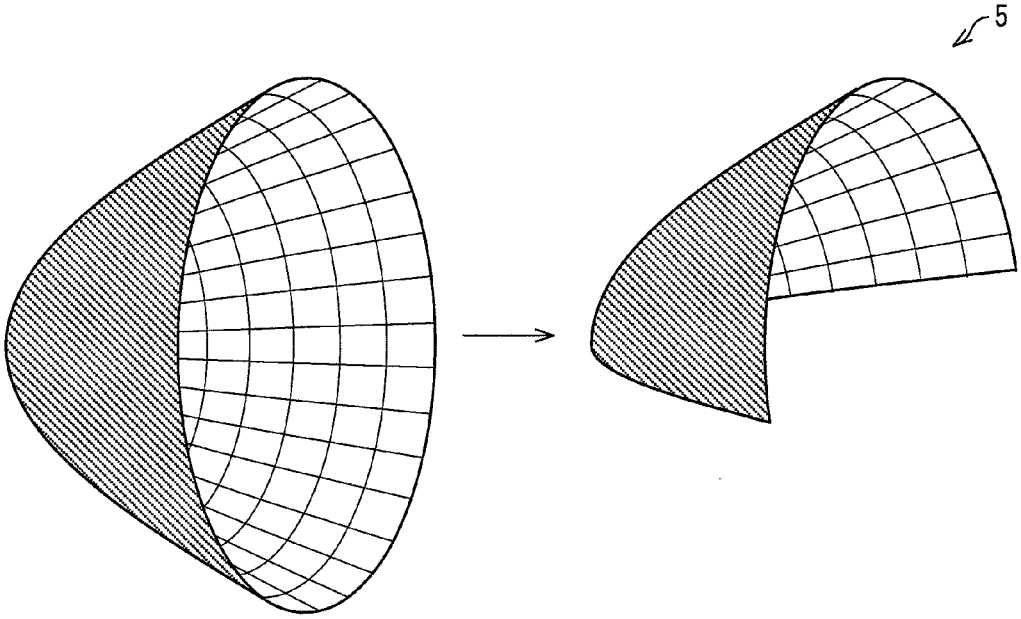
FIG. 2 is a conceptual view of a paraboloid of revolution of a parabolic mirror.
Figure 3:
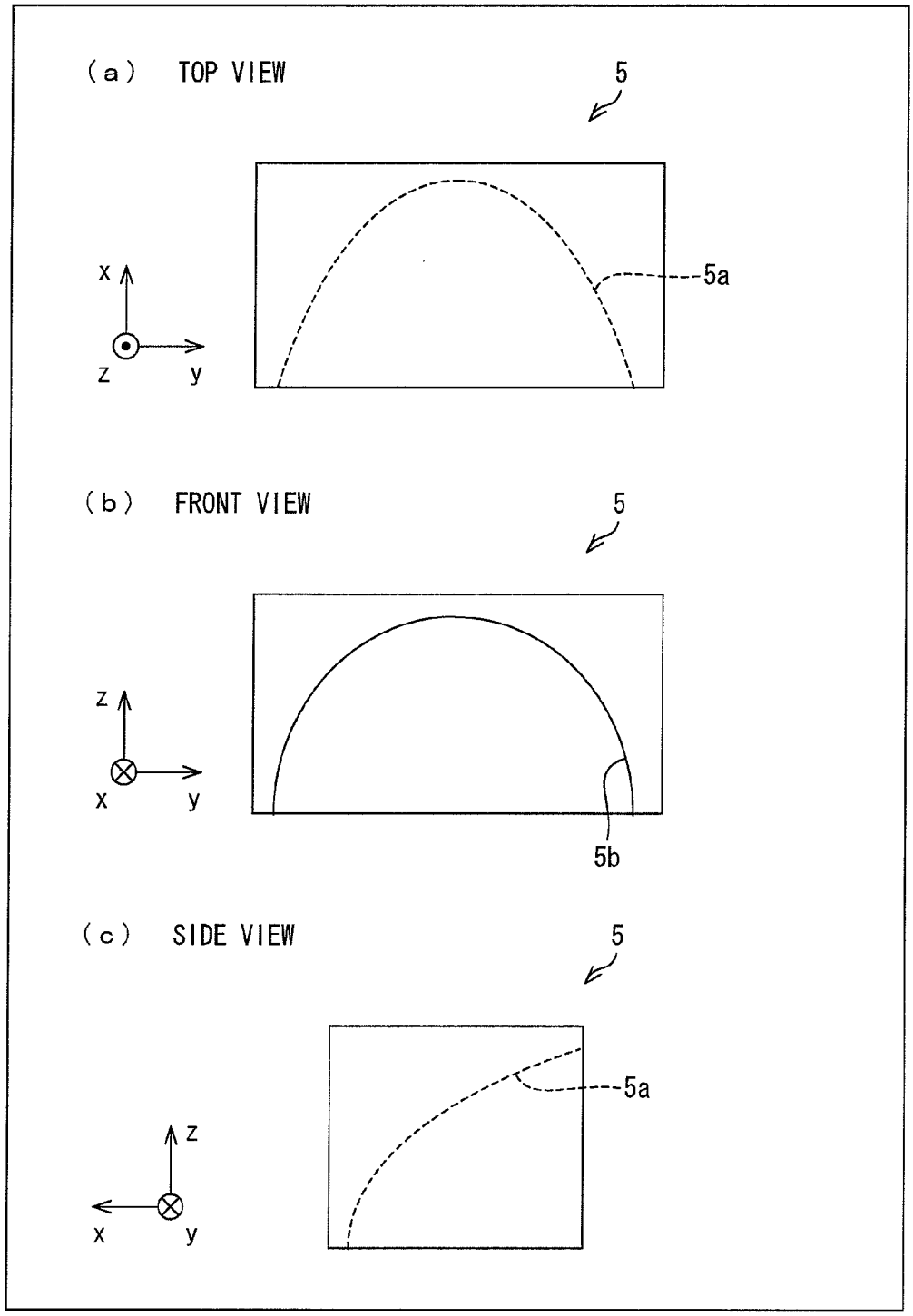
FIG. 3 (*a*) of FIG. 3 is a top view of a parabolic mirror, (*b*) of FIG. 3 is a front view of the parabolic mirror, and (*c*) of FIG. 3 is a side view of the parabolic mirror.

FIG. 2 is a conceptual view of a paraboloid of revolution of the parabolic mirror 5. (*a*) of FIG. 3 is a top view of the parabolic mirror 5, (*b*) of FIG. 3 is a front view thereof, and (*c*) of FIG. 3 is a side view thereof. In order to illustrate these figures intelligibly, (*a*) to (*c*) of FIG. 3 illustrate an example where a parabolic mirror 5 is formed under a state in which inside of a rectangular parallelepiped member is hollowed out.

As illustrated in FIG. 2, the parabolic mirror 5 includes, in its reflection surface, at least a part of a partially curved-surface which has a shape obtainable by cutting off a curved surface (parabolic curved surface) formed by rotating a parabola about a symmetric axis of the parabola as a rotation axis, the cutting off being cutting the curved surface along a plane including the rotation axis. In (*a*) to (*c*) of FIG. 3, the parabolic curved surface is indicated by a curved line 5*a*. Further, as illustrated in (*b*) of FIG. 3, in the case where the parabolic mirror 5 is seen in front view, an opening 5*b* of the parabolic mirror 5 (i.e., an exit of illumination light) has a semicircle.

Further, the laser element 2 is placed outside the parabolic mirror 5, and the parabolic mirror 5 includes a window section 6 through which a laser beam transmits or passes. The window section 6 may be an opening or a section including a transparent member that allows the laser beam to transmit therethrough. For example, the window section 6 may be a transparent plate including a filter that allows the laser beam to transmit therethrough and reflects the white light (fluorescence from the light emitting section 4). This arrangement can prevent the fluorescence from the light emitting section 4 from leaking through the window section 6.

One common window section 6 may be provided for the plurality of laser elements 2, or a plurality of window sections 6 may be provided so that each of the window sections 6 is provided for one or more of the plurality of laser elements 2.

Note that the parabolic mirror 5 may partially include a nonparabolic part. Further, the reflection mirror included in the light emitting device of the present invention may be a parabolic mirror having a closed-circle shaped opening or may include a part of the parabolic mirror. Furthermore, the reflection mirror is not limited to a parabolic mirror, and may alternatively be an ellipsoidal mirror or a hemispherical mirror. In other words, the reflection mirror only needs to include, in its reflection surface, at least a part of a curved surface formed by rotating a pattern (ellipse, circle, or parabola) about a rotation axis of the pattern.

(Metal Base 7)

The metal base 7 is a plate-like support for supporting the light emitting section 4 and is made of metal (e.g., copper or iron). Hence, the metal base 7 has high thermal conductivity and therefore can effectively contribute to radiation of heat emitted from the light emitting section 4. Note that a member for supporting the light emitting section 4 is not limited to a member made of metal, and may be made of a member containing a material having high heat conductivity (e.g., glass or sapphire) other than metal. However, a surface of the metal base 7, which surface is in contact with the light emitting section 4, preferably functions as a reflection surface. The surface functioning as a reflection surface can reflect the fluorescence and direct the fluorescence toward the parabolic mirror 5 after the laser beam incident from above the light emitting section 4 is converted into fluorescence. Furthermore, the reflection surface reflects the laser beam incident from above the light emitting section 4 to the reflection surface and directs the laser beam back to the inside of the light emitting section 4.

Because the metal base 7 is covered with the parabolic mirror 5, it can be said that the metal base 7 has a surface facing the reflecting curved-surface (parabolic curved-surface) of the parabolic mirror 5. It is preferable that the surface of the metal base 7 on which the light emitting section 4 is provided is substantially in parallel to the rotation axis of the paraboloid of revolution of the parabolic mirror 5 and substantially includes the rotation axis.

(Fin 8)

The fin 8 functions as a cooling section (mechanism of heat radiation) for cooling the metal base 7. The fin 8 includes a plurality of heat sinks, and these heat sinks increase an area in contact with air, to thereby improve heat radiation efficiency. The cooling section for cooling the metal base 7 only needs to have a cooling (heat radiation) function, so that a cooling section including a heat pipe or a cooling section having a water-cooling system or an air-cooling system may be used.

[How to Provide Headlamp 1]

Figure 4:
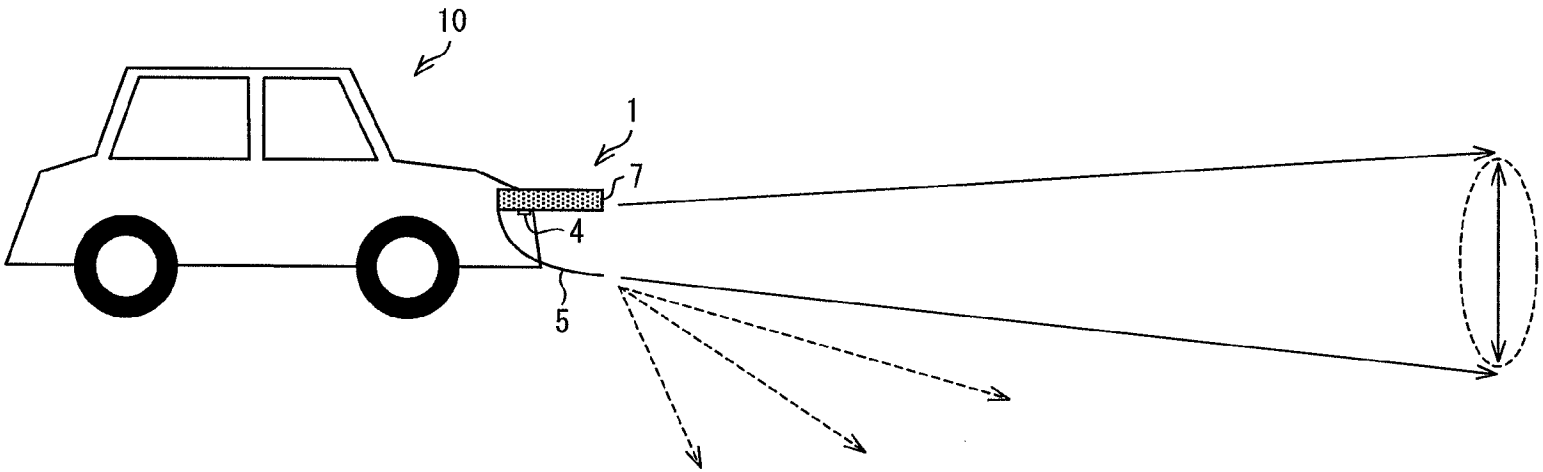
FIG. 4 is a conceptual view illustrating a direction in which a headlamp is provided in a vehicle.

FIG. 4 is a conceptual view illustrating a direction in which a headlamp 1 is provided in the case where the headlamp 1 is used for a headlamp of an automobile (vehicle) 10. As illustrated in FIG. 4, the headlamp 1 may be provided to a head of the vehicle 10 so that the parabolic mirror 5 is positioned on the lower side of the headlamp 1 in the vertical direction. By providing the headlamp 1 in the aforementioned way, the headlamp 1 projects light not only toward a due forward direction of the automobile 10 brightly, but also toward an area in lower front of the automobile 10 appropriately due to a light-projection characteristic of the parabolic mirror 5.

Note that the headlamp 1 may be used as a driving headlamp (high beam) for a vehicle, or may be used as a passing headlamp (low beam). Further, during driving of the automobile 10, light intensity distribution of a laser beam which irradiates the irradiation surface of the light emitting section 4 may be controlled in accordance with a driving state. This makes it possible to project light having an arbitrary light-projection pattern during driving of the automobile 10, and therefore the headlamp 1 can be more convenient for a user.

[Application Example of the Present Invention]

A light emitting device of the present invention may be used not only in a vehicle headlamp but also in another illumination device. One example of the illumination device of the present invention is a downlight. The downlight is an illumination device provided onto a ceiling of a structure such as a house or a vehicle. In addition, the illumination device of the present invention may be accomplished as a headlamp for a moving object other than a vehicle (e.g., human, ship, aircraft, submarine, or rocket), or may be accomplished as interior lighting equipment (e.g., stand lamp) other than a searchlight, a projector, and a downlight.

[Excitation of Light Emitting Section of Headlamp 1 or the Like]

Next, excitation of light emitting section of headlamp 1 or the like will be described with reference to FIGS. 5 and 6.

Figure 5:
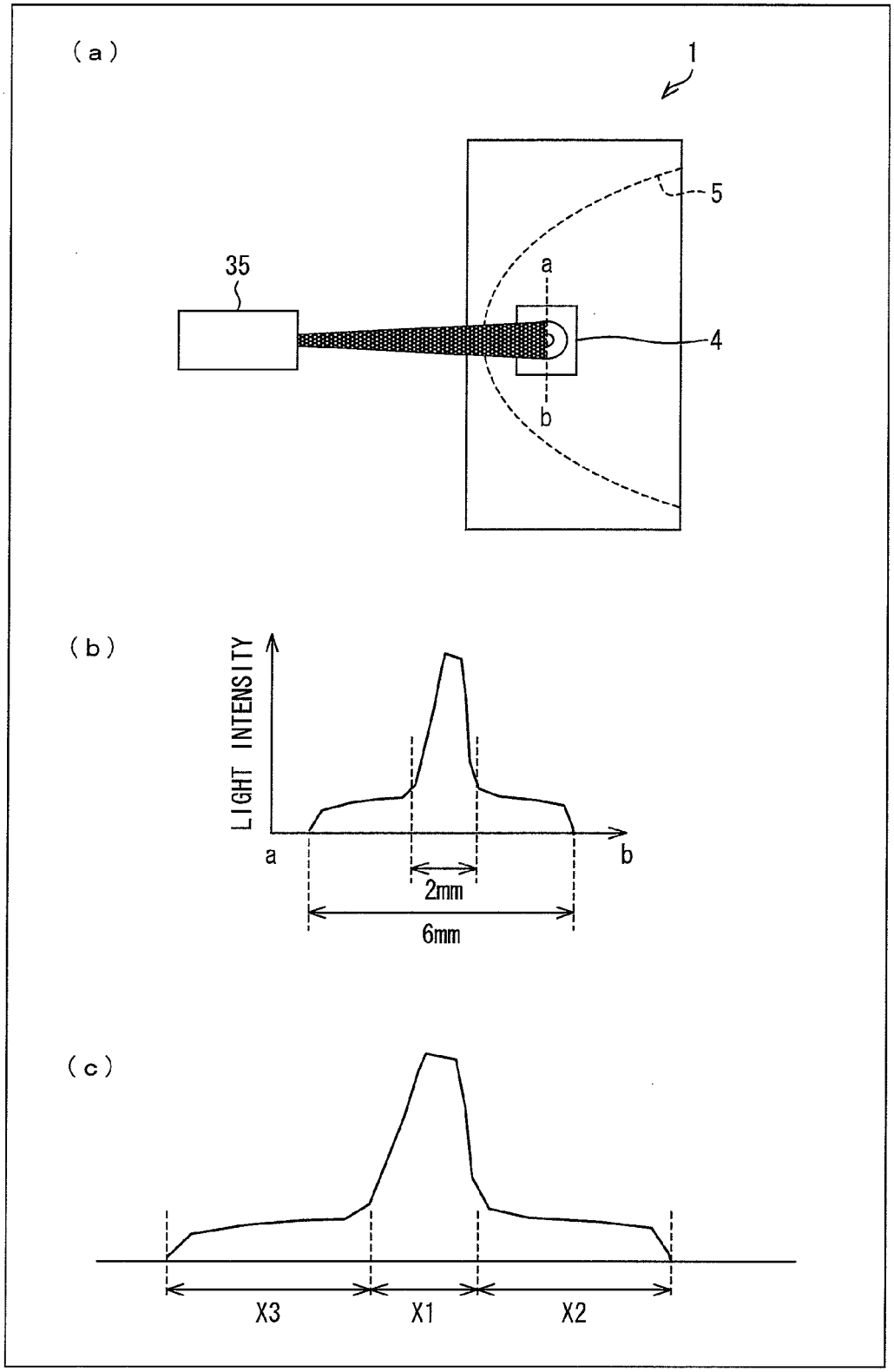
FIG. 5 illustrate an example of a light-projection pattern when a headlamp used as a vehicle headlamp projects light toward a road: (*a*) of FIG. 5 illustrates a state in which a light emitting section is irradiated with a laser beam from a laser beam source unit, which light emitting section is placed so that a focal point of a parabolic mirror and a periphery of the focal point are positioned on the light emitting section; (*b*) of FIG. 5 illustrates an example of light intensity distribution of the laser beam in an a-b direction of (*a*) of FIG. 5; and (*c*) of FIG. 5 illustrates a state in which light is projected toward a road which is a target to be illuminated with light (such state is called a light-projection pattern) by exciting the light emitting section with use of the laser beam having the light intensity distribution of (*b*) of FIG. 5.

FIG. 5 illustrates an example of a light-projection pattern when the headlamp 1 used as a vehicle headlamp projects light toward a road. Specifically, (*a*) of FIG. 5 illustrates a state in which a light emitting section 4 is irradiated with a laser beam from a laser beam source unit 35, which light emitting section 4 is placed so that a focal point of the parabolic mirror 5 and a periphery of the focal point are positioned on the light emitting section 4; (*b*) of FIG. 5 illustrates an example of light intensity distribution of the laser beam in an a-b direction of (*a*) of FIG. 5; and (*c*) of FIG. 5 illustrates a state in which light is projected toward a road which is a target to be illuminated with light (such state is called a light-projection pattern) by exciting the light emitting section 4 with use of the laser beam having the light intensity distribution of (*b*) of FIG. 5.

In (*a*) of FIG. 5, the laser beam source unit 35 most strongly excites the portion of the light emitting section 4, which portion corresponds to the focal point of the parabolic mirror 5, and excites the portion corresponding to a periphery of the focal point with intensity being dependent on light intensity distribution of a laser beam on an irradiation surface of the light emitting section 4. Specification of the laser beam source unit 35 is not particularly limited as long as the laser beam source unit 35 is operated as described above. Therefore the laser beam source unit 35 may be accomplished by including one or a combination of control mean for controlling light intensity distributions illustrated in FIGS. 7 to 13. Alternatively, the laser beam source unit 35 may be accomplished by including control means other than the arrangements illustrated in FIGS. 7 to 13 or by including an arrangement of emitting a laser beam having Gaussian distribution.

The laser beam has the light intensity distribution of (*b*) of FIG. 5 in the a-b direction of (*a*) of FIG. 5, and excites the light emitting section 4 with the intensity being dependent on the light intensity distribution. For example, light intensity of a light irradiation region defined by a range of "2 mm" in (*b*) of FIG. 5 is high, and light intensity of a light irradiation region defined by a range of "6 mm" other than the range of 2 mm is low.

By exciting the light emitting section 4 with a laser beam having a characteristic shown in (*b*) of FIG. 5, the light-projection pattern illustrated in (*c*) of FIG. 5 can be projected toward a road which is a target to be illuminated with light.

Herein, the light-projection pattern of (*c*) of FIG. 5 is divided into three, i.e., X1, X2, and X3.

X1 is a light-projection pattern of light obtained when the light emitting section 4 is excited by light intensity of the light irradiation region defined by the range of 2 mm of (*b*) of FIG. 5, which light irradiation region corresponds to the focal point of the parabolic mirror 5. Light from the range defined by X1 is brightly projected toward a due forward direction of the parabolic mirror 5 with a narrow solid angle, and the light defined by X1 is projected more brightly than that defined by X2 and X3. If the light-projection pattern defined by X1 is used for a vehicle during driving, a center of a road can be illuminated with enough brightness.

On the other hand, X2 and X3 are a light-projection pattern of light obtained by exciting the light emitting section 4 by light intensity of the light irradiation region defined by the range of 6 mm other than that defined by the range of 2 mm of (*b*) of FIG. 5. Because the light in the range defined by X2 and X3 is generated by exciting the light emitting section 4 in an area off the focal point of the parabolic mirror 5, the light in the range defined by X2 and X3 is projected with a wide solid angle and has a light-projection pattern wider than the range defined by X1. If the light-projection pattern of X2 and X3 is used for a vehicle during driving, an area around the road (e.g., sidewalk and roadside tree) can be illuminated with appropriate brightness.

As described above, the brightness of a target to be illuminated with light can be changed by exciting the light emitting section 4 with use of a laser beam having the characteristic of (*b*) of FIG. 5. As a result, a light-projection pattern can be provided to a user in accordance with a use for or a usage state of the headlamp 1.

Figure 6:
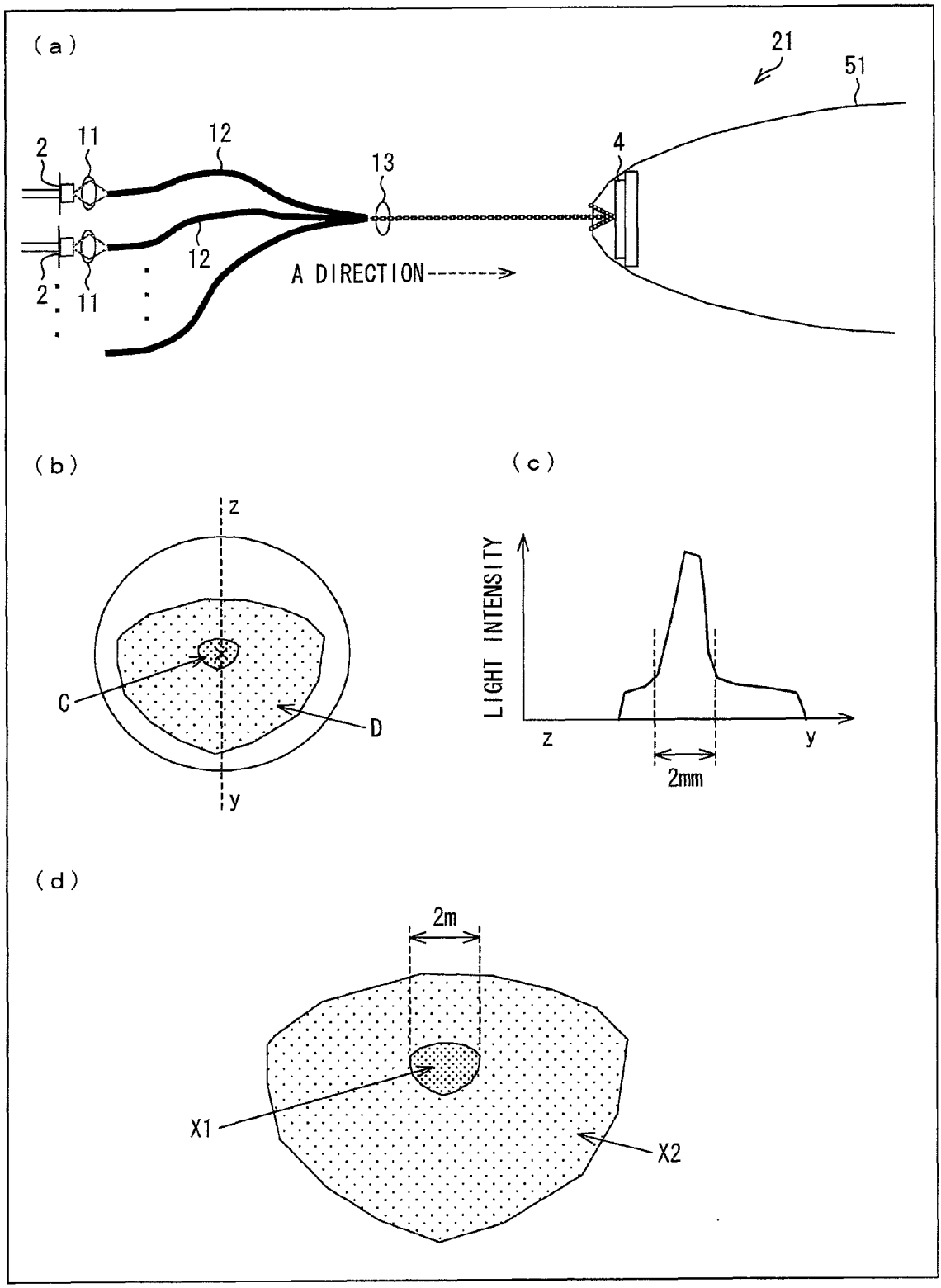
FIG. 6 illustrate one example of a light-projection pattern in the case where a headlamp including a circular paraboloid projects light toward a road: (*a*) of FIG. 6 illustrates a state in which a light emitting section is irradiated with laser beams from a plurality of laser elements, which light emitting section is placed so that a focal point of the circular paraboloid and a periphery of the focal point are positioned on the light emitting section; (*b*) of FIG. 6 illustrates light intensity distribution of the laser beam on the light emitting section when seeing in an A direction of (*a*) of (*c*) of FIG. 6 of FIG. 6 illustrates one example of the light intensity distribution of the laser beam in a y-z direction of (*b*) of FIG. 6; and (*d*) of FIG. 6 illustrates a state in which light is projected toward a road which is a target to be illuminated with light (such state is called a light-projection pattern) by exciting the light emitting section with use of the laser beam having the light intensity distribution of (*c*) of FIG. 6.

FIG. 6 illustrates one example of the light-projection pattern in the case where a headlamp 21 including a circular parabolic mirror 51 projects light toward a road. Specifically, (*a*) of FIG. 6 illustrates a state in which a light emitting section 4 are irradiated with laser beams from a plurality of laser elements 2, which light emitting section 4 is placed so that a focal point of the circular paraboloic mirror 51 and a periphery of the focal point are positioned on the light emitting section 4. (*b*) of FIG. 6 illustrates light intensity distribution of the laser beam on the light emitting section when seeing in an A direction of (*a*) of FIG. 6. (*c*) of FIG. 6 illustrates one example of the light intensity distribution of the laser beam in a y-z direction of (*b*) of FIG. 6. (*d*) of FIG. 6 illustrates a state in which light is projected toward a road which is a target to be illuminated with light (such state is called a light-projection pattern) by exciting the light emitting section 4 with use of the laser beam having the light intensity distribution of (*c*) of FIG. 6.

Herein, in (*a*) of FIG. 6, the light emitting section 4 is irradiated with the laser beams emitted from these laser elements 2 via an optical fiber 12. Further, (*b*) of FIG. 6 illustrates the light intensity distribution of the laser beam on the light emitting section 4. A region C which surrounds a mark x is irradiated with a laser beam having the highest light intensity, and a region D surrounding the region C is irradiated with a laser beam having a relatively lower light intensity. That is, a light irradiation region defined by the range of 2 mm of (*c*) of FIG. 6 corresponds to the region C which is irradiated with the laser beam having the highest light intensity, and a light irradiation region other than that defined by the range of 2 mm of (*c*) of FIG. 6 corresponds to the region D which is irradiated with the laser beam having the relatively lower light intensity.

Herein, the light-projection pattern of (*d*) of FIG. 6 is divided into two, i.e., X1 and X2.

X1 is a light-projection pattern of light obtained when the light emitting section 4 is excited by light intensity of the light irradiation region defined by the range of 2 mm of (*c*) of FIG. 6, which light irradiation region corresponds to the focal point of the parabolic mirror 5. Light from the range defined by X1 is brightly projected toward a due forward direction of the parabolic mirror 5 with a narrow solid angle, and the light defined by X1 is projected more brightly than that defined by X2. If the light-projection pattern defined by X1 is used for a vehicle during driving, a center of a road can be illuminated with enough brightness.

On the other hand, X2 is a light-projection pattern of light obtained by exiting the light emitting section 4 by light intensity of the light irradiation region other than that defined by the range of 2 mm of (*c*) of FIG. 6. By exiting the light emitting section 4 in an area off the focal point of the parabolic mirror 5, the light in the range defined by X2 is projected with a wide solid angle and has a light-projection pattern wider than the range defined by X1. If the light-projection pattern of X2 is used for a vehicle during driving, an area around the road (e.g., sidewalk and roadside tree) can be illuminated with appropriate brightness.

As described above, the brightness of a target to be illuminated with light can be changed by irradiating the light emitting section 4 with a laser beam having the characteristic of (*c*) of FIG. 6. As a result, a light-projection pattern can be provided to a user in accordance with a use for or a usage state of the headlamp 21.

Note that the circle parabolic mirror 51 of FIG. 6 has a paraboloid of revolution as a reflecting curved-surface and a closed-circle shaped opening. That is, the circle parabolic mirror 51 includes, in its reflection surface, at least a part of a curved surface formed by rotating a parabola about a symmetric axis of the parabola as a rotation axis.

[Control of Light Intensity Distribution of Laser Beam Irradiating Irradiation Surface]

An arrangement for controlling light intensity distribution of a laser beam on the irradiation surface of the light emitting section 4 as the surface irradiated with a laser beam will be described with reference to FIGS. 7 to 13 as below.

Note that FIGS. 7 to 13 illustrate one example for controlling the light intensity distribution of the laser beam on the irradiation surface of the light emitting section 4, but the light intensity distribution may be controlled with another method.

In FIGS. 7 to 13, P (also referred to as P1, P2) indicates a position from which a laser beam is emitted, and an example of the position encompasses an end of an optical fiber, a light source of a laser beam, or the like. Further, Q (also referred to as Q1, Q2) indicates a converging point of a laser beam. Furthermore, L indicates an imaginary locus in the case where a laser beam travels straight while transmitting through the light emitting section 4. Still further, R indicates a position on which the irradiation surface of the light emitting section 4 is placed. Herein, the light emitting section 4 is placed so that the portion corresponding to the focal point of the reflection mirror and the portion corresponding to the periphery of the focal point are positioned on the light emitting section 4.

[Compound Lens and a Plurality of Converging Lens]

Figure 7:
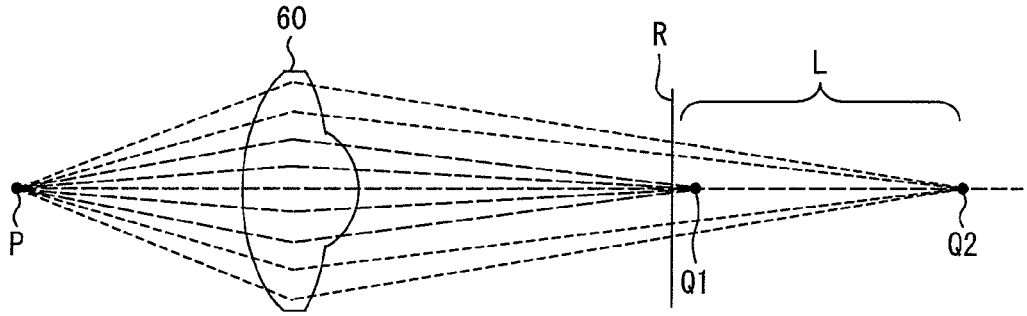
FIG. 7 is an explanatory view of an example where a compound lens constituted by two lenses having respective different optical characteristics is used for controlling light intensity distribution of a laser beam on an irradiation surface.

FIG. 7 is an explanatory view of an example where a compound lens (light intensity distribution control means) 60 constituted by two lenses having respective different optical characteristics is used for controlling light intensity distribution of a laser beam on the irradiation surface.

Herein, specification of the compound lens 60 is not particularly limited. For example, the compound lens 60 may be obtained by attaching a convex lens and a concave lens, having respective different optical characteristics, to each other.

As illustrated in FIG. 7, when a laser beam emitted from a position P is incident on the compound lens 60, the laser beam changes its traveling path so that the laser beam converges upon a converging point Q1 and a converging point Q2. The light emitting section 4 is placed at an R position, so that some rays of the laser beam are converged upon the converging point Q1, and other rays of the laser beam are converged upon the converging point Q2, whereby the some rays and the other lays of the laser beam form light intensity distribution on the irradiation surface of the light emitting section 4.

That is, with the arrangement shown in FIG. 7, the light emitting section can be most strongly excited at the portion corresponding to the focal point of the reflection mirror, meanwhile, at the portion corresponding to the periphery of the focal point, the light emitting section can be excited with intensity being dependent on light intensity distribution of a laser beam on the irradiation surface. Further, a pattern of the light intensity distribution can be appropriately controlled by appropriately changing specification of the compound lens 60, the position of P, etc. This makes it possible to desirably control the light-projection pattern of the headlamp.

Figure 8:
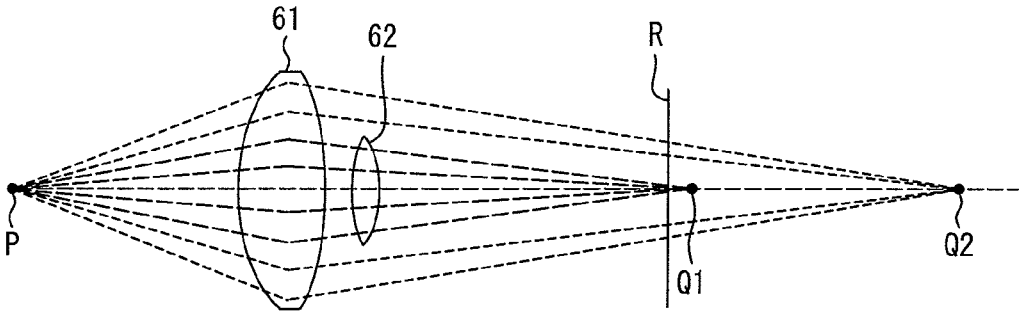
FIG. 8 is an explanatory view of an example where converging lenses having respective different optical characteristics are used for controlling light intensity distribution of a laser beam on an irradiation surface.

Herein, FIG. 8 illustrates a modification of the compound lens 60 of FIG. 7. FIG. 8 is an explanatory view of an example where a converging lens 61 and a converging lens 62 having respective different optical characteristics are used for controlling light intensity distribution of a laser beam on the irradiation surface. Note that specifications of the converging lens 61 and converging lens 62 are not particularly limited.

As illustrated in FIG. 8, when a laser beam emitted from the position P is incident on the converging lens 61, the laser beam changes its traveling path so that the laser beam converges upon a converging point Q2. Then, some rays of the laser beam travel along the traveling path thus changed and converge upon the converging point Q2 without entering through the converging lens 62. Meanwhile, other rays of the laser beam are incident on the converging lens 62 and then the other rays change their traveling path so that the other rays converge upon the converging point Q1. The light emitting section 4 is placed at an R position, so that some rays of the laser beam are converged upon the converging point Q1, and other rays of the laser beam are converged upon the converging point Q2, whereby the some rays and the other rays of the laser beam form light intensity distribution on the irradiation surface of the light emitting section 4.

That is, with the arrangement shown in FIG. 8, the light emitting section can be most strongly excited at the portion corresponding to the focal point, meanwhile, at the portion corresponding to the periphery of the focal point, the light emitting section can be excited with intensity being dependent on light intensity distribution of a laser beam on an irradiation surface of the light emitting section. Further, a pattern of the light intensity distribution can be appropriately controlled by appropriately changing specifications of the converging lens 61, the converging lens 62, the position of P, etc. This makes it possible to desirably control the light-projection pattern of the headlamp. Further, in order to form light intensity distribution, three or more converging lenses may be used.

[Converging Lens and Aperture]

Figure 9:
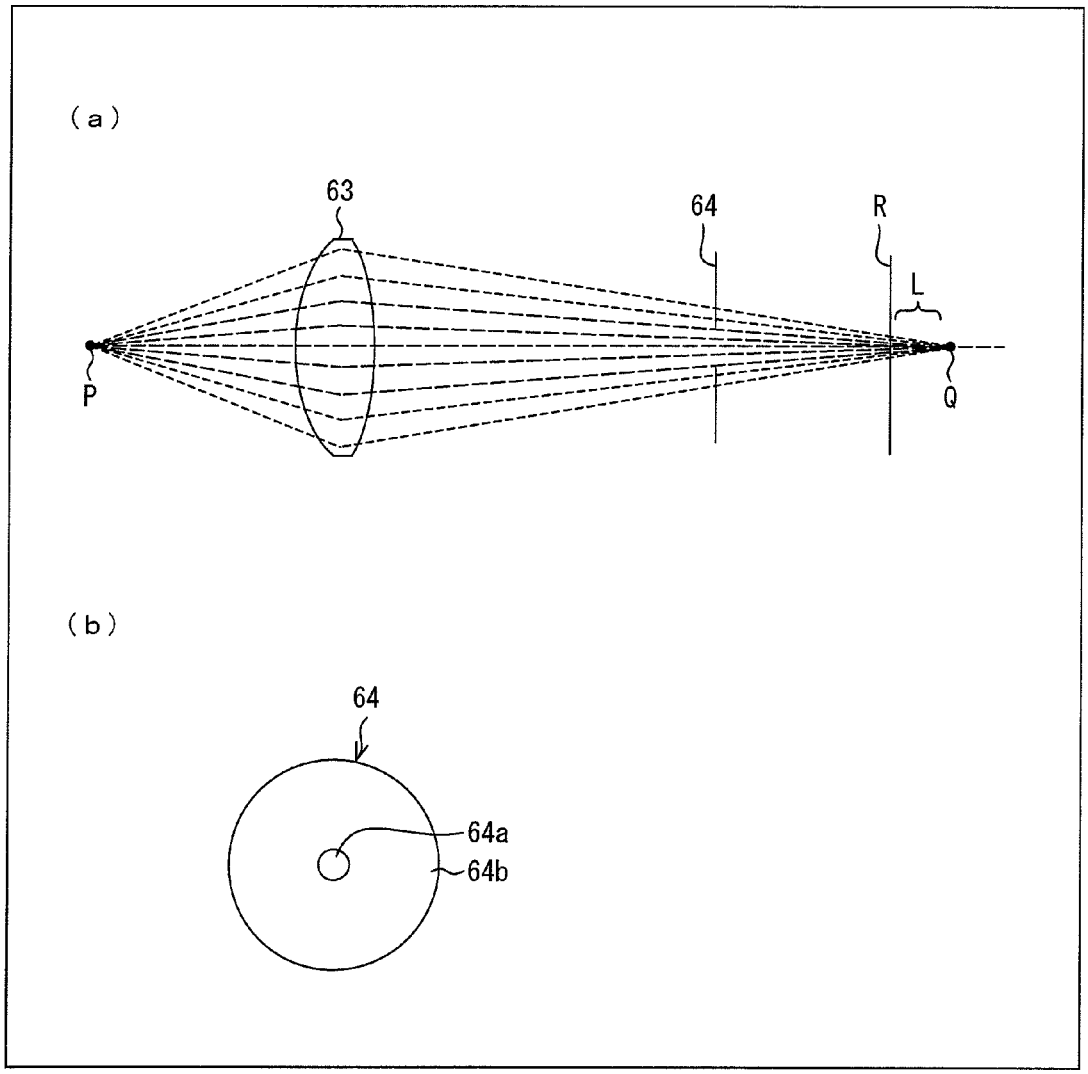
FIG. 9 illustrate an example where a converging lens and an aperture are used for controlling light intensity distribution of the laser beam on an irradiation surface, where the converging lens converges upon a light emitting section a laser beam emitted from a laser element, and the aperture provides different light transmittances depending on paths of the laser beam passed through the converging lens; (*a*) of FIG. 9 is a schematic view of the device; (*b*) of FIG. 9 is a schematic view of the aperture.

FIG. 9 illustrates an example where a converging lens 63 and an aperture 64 are used for controlling light intensity distribution of the laser beam on an irradiation surface, where the converging lens 63 converges upon a light emitting section 4 a laser beam emitted from a laser element 2, and the aperture 64 provides different light transmittances depending on paths of the laser beam passed through the converging lens. In FIG. 9, (*a*) of FIG. 9 is a schematic view of the device, and (*b*) of FIG. 9 is a schematic view of the aperture 64.

Specification of the converging lens 63 is not particularly limited. Further, in (*b*) of FIG. 9, the aperture 64 has an opening 64*a* in its center, and a part surrounding the opening 64*a* is constituted by, for example, a semitransparent (e.g., frosted-glass like) region 64*b* having a transmittance of 50%. Note that specification of the aperture 64 is not particularly limited, and may be constituted by another arrangement.

As illustrated in (*a*) of FIG. 9, when a laser beam emitted from a position P is incident on the converging lens 63, the laser beam changes its traveling path so that the laser beam converges upon a converging point Q. The aperture 64 of (*b*) of FIG. 9 is placed in the traveling path between the converging lens 63 and the converging point Q. With this, the irradiation surface of the light emitting section 4 is irradiated with some rays of a laser beam, which some rays have passed through the opening of the aperture 64, and other rays of the laser beam, which other rays have passed through a semitransparent section (having a transmittance of 50%) of the aperture 64. Because the some rays of the laser beam and other rays thereof have respective different light intensities caused by the difference of the transmittances, light intensity distribution is formed on the irradiation surface.

As a result, with the arrangement shown in FIG. 9, the portion corresponding to the focal point of the reflection mirror can be most strongly excited, and the portion corresponding to the periphery of the focal point can be excited with intensity being dependent on light intensity distribution of a laser beam on the irradiation surface. Further, a pattern of the light intensity distribution can be appropriately controlled by appropriately changing specifications of the converging lens 63 and the aperture 64, the position of P, etc. This makes it possible to desirably control the light-projection pattern of the headlamp.

[A Plurality of Converging Lenses]

Figure 10:
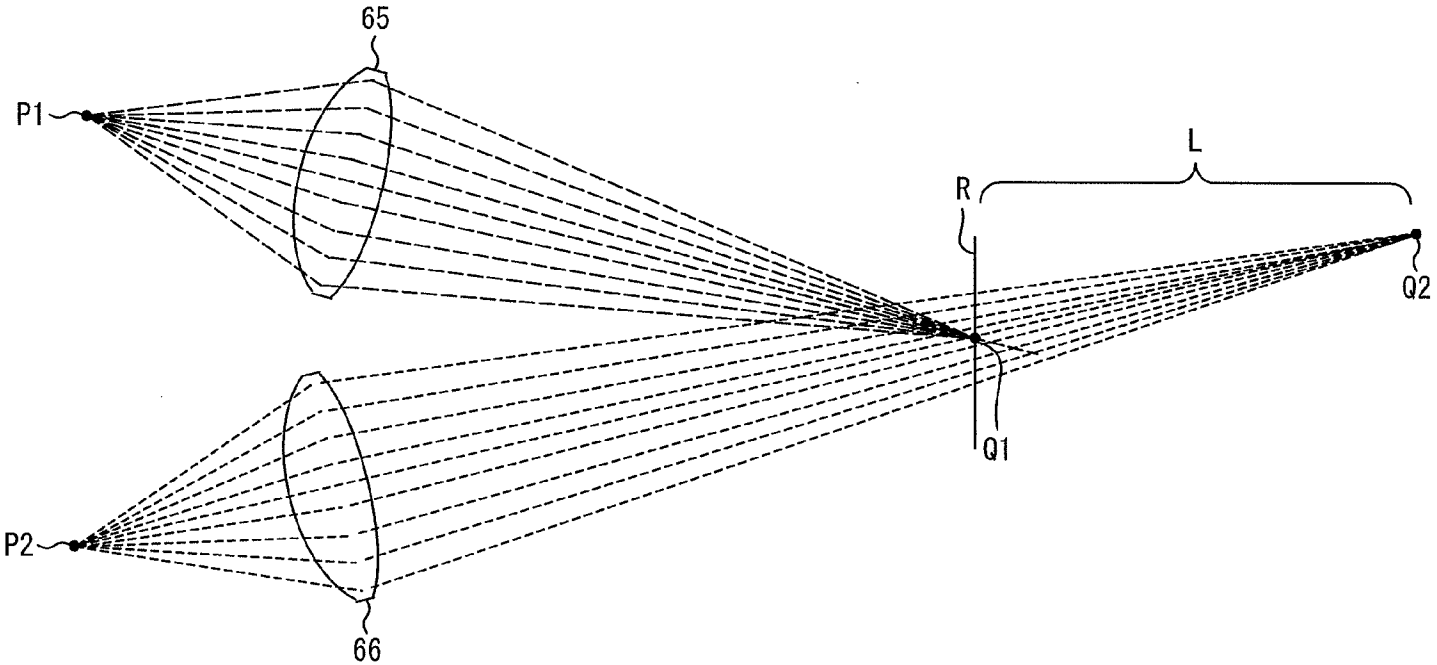
FIG. 10 is an explanatory view of an example where a plurality of laser elements provided respectively with converging lenses for converging upon a light emitting section laser beams emitted from these laser elements, in order to control light intensity distribution of laser beams on an irradiation surface.

FIG. 10 is an explanatory view of an example where a plurality of laser elements 2 provided respectively with converging lenses for converging upon a light emitting section 4 laser beams emitted from these laser elements 2, in order to control light intensity distribution of laser beams on an irradiation surface. In FIG. 10, a converging lens 65 is provided in correspondence with a laser element 2 provided on a position P1, and a converging lens 66 is provided in correspondence with a laser element 2 provided on a position P2. Note that specifications of the converging lens 65 and converging lens 66 are not particularly limited.

As illustrated in FIG. 10, when a laser beam emitted from the position P1 is incident on the converging lens 65, the laser beam changes its traveling path so that the laser beam converges upon a converging point Q1. Further, when a laser beam emitted from the position P2 is incident on the converging lens 66, the laser beam changes its traveling path so that the laser beam converges upon a converging point Q2. The light emitting section 4 is placed at an R position, so that the laser beam is converged upon the converging point Q1 and the laser beam is converged upon the converging point Q2, whereby the laser beams form light intensity distribution on the irradiation surface of the light emitting section 4.

That is, with the arrangement shown in FIG. 10, a portion corresponding to the focal point of the reflection mirror can be most strongly excited by the laser beam converged upon the converging point Q1. Further, a periphery of the focal point can be excited by a combination of the laser beams converging upon the converging points Q1 and Q2 with intensity being dependent on light intensity distribution of the laser beam on the irradiation surface. Further, a pattern of the light intensity distribution can be appropriately controlled by appropriately changing specifications of the converging lens 65 and the converging lens 66, the positions of P1 and P2, etc. This makes it possible to desirably control the light-projection pattern of the headlamp.

[Parallel Lens and Concave Mirror]

Figure 11:
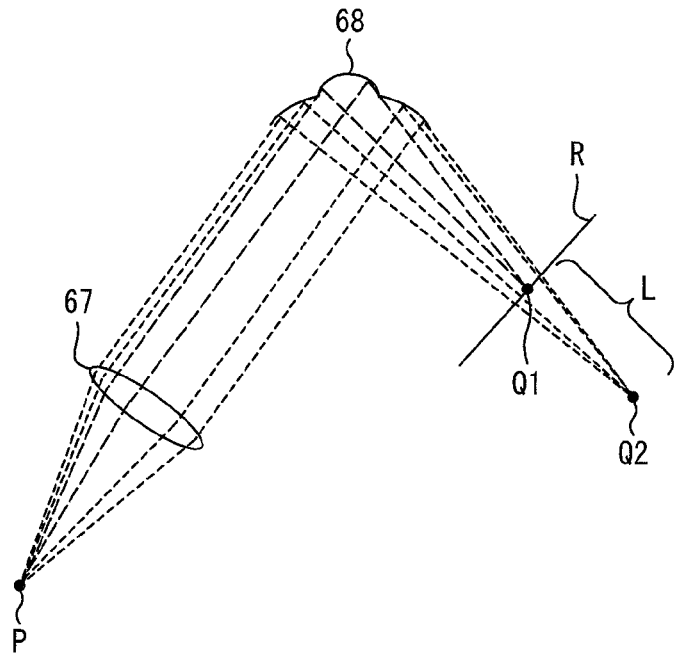
FIG. 11 illustrates an example where a convex lens for converting a laser beam of a laser element into parallel light and a concave mirror for receiving the parallel light as incident light and reflecting the incident light toward two focal points are used for controlling light intensity distribution of the laser beam on an irradiation surface.

FIG. 11 illustrates an example where a convex lens 67 for converting a laser beam of a laser element 2 into parallel light and a concave mirror 68 for receiving the parallel light as incident light and reflecting the incident light toward two focal points are used for controlling light intensity distribution of the laser beam on an irradiation surface. Herein, specifications of the convex lens 67 and the concave mirror 68 are not particularly limited as long as the convex lens 67 and the concave mirror 68 are operated as below.

As illustrated in FIG. 11, a laser beam of a position P is converted into a parallel light by entering through the convex lens 67. Then the parallel light is incident on the concave mirror 68 and the incident parallel light is reflected from the concave mirror 68 toward two converging points Q1 and Q2. The light emitting section 4 is placed at an R position, so that some rays of the laser beam are converged upon the converging point Q1, and other rays of the laser beam are converged upon the converging point Q2 form light intensity distribution on the irradiation surface of the light emitting section 4.

That is, with the arrangement shown in FIG. 11, a portion corresponding to the focal point of the reflection mirror can be most strongly excited by the some rays of the laser beam, which some rays converge upon the converging point Q1. Further, a periphery of the focal point can be excited, by a combination of the some rays converging upon the converging points Q1 and the other rays converging upon the converging point Q2 with intensity being dependent on light intensity distribution of the laser beam on the irradiation surface. Further, a pattern of the light intensity distribution can be appropriately controlled by appropriately changing specifications of the convex lens 67 and the concave mirror 68, the position of P, etc. This makes it possible to desirably control the light-projection pattern of the headlamp.

[Parallel Lens, Concave Mirror, and Aperture]

Figure 12:
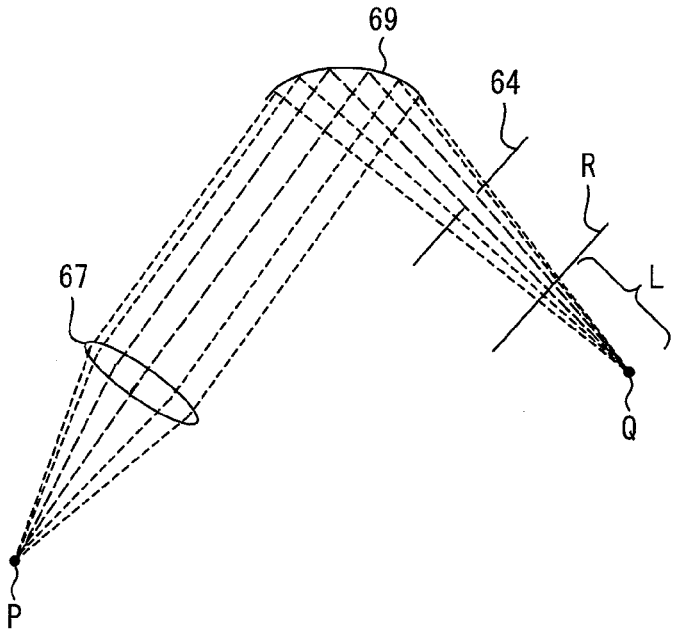
FIG. 12 illustrates an example where a convex lens for converting a laser beam, emitted from a laser element, into parallel light, a concave mirror for receiving parallel light as incident light reflecting the incident light toward one focal point and an aperture that provides different light transmittances depending on paths of the laser beam reflected on the concave mirror are used for controlling light intensity distribution of a laser beam on an irradiation surface.

FIG. 12 illustrates an example where a convex lens 67 for converting a laser beam, emitted from a laser element, into parallel light, a concave mirror 69 for receiving the parallel light as incident light reflecting the incident light toward one focal point, and an aperture 64 that provides different light transmittances depending on paths of the laser beam reflected on the concave mirror 69 are used for controlling light intensity distribution of a laser beam on an irradiation surface. Herein, specifications of the convex lens 67, the concave mirror 69, and the aperture 64 are not particularly limited as long as the convex lens 67, the concave mirror 69, and the aperture 64 are operated as below.

As illustrated in FIG. 12, a laser beam of a position P is converted into a parallel light by entering through the convex lens 67. Then the parallel light is incident on the concave mirror 69 and the incident light is reflected from the concave mirror 69 toward the converging point Q. Then, the aperture 64 of (*b*) of FIG. 9 is placed at a path between the concave mirror 69 and the converging point Q. With this, the irradiation surface of the light emitting section 4 is irradiated with some rays of a laser beam, which some rays have passed through the opening of the aperture 64, and other rays of the laser beam, which other rays have passed through a semi-transparent section (having a transmittance of 50%) of the aperture 64. At this time, because the some rays of the laser beam and the other rays thereof have respective different light intensities caused by the difference of the transmittance, light intensity distribution is formed on the irradiation surface of the light emitting section 4.

As a result, with the arrangement shown in FIG. 12, a portion corresponding to the focal point of the reflection mirror can be most strongly excited, and the portion corresponding to the periphery of the focal point can be excited with intensity being dependent on light intensity distribution of a laser beam on the irradiation surface. Further, a pattern of the light intensity distribution can be appropriately controlled by appropriately changing specifications of the convex lens 67, the concave mirror 69, and the aperture 64, the position of P, etc. This makes it possible to desirably control the light-projection pattern of the headlamp.

[Use of a Plurality of Parallel Lenses and a Plurality of Concave Mirrors]

Figure 13:
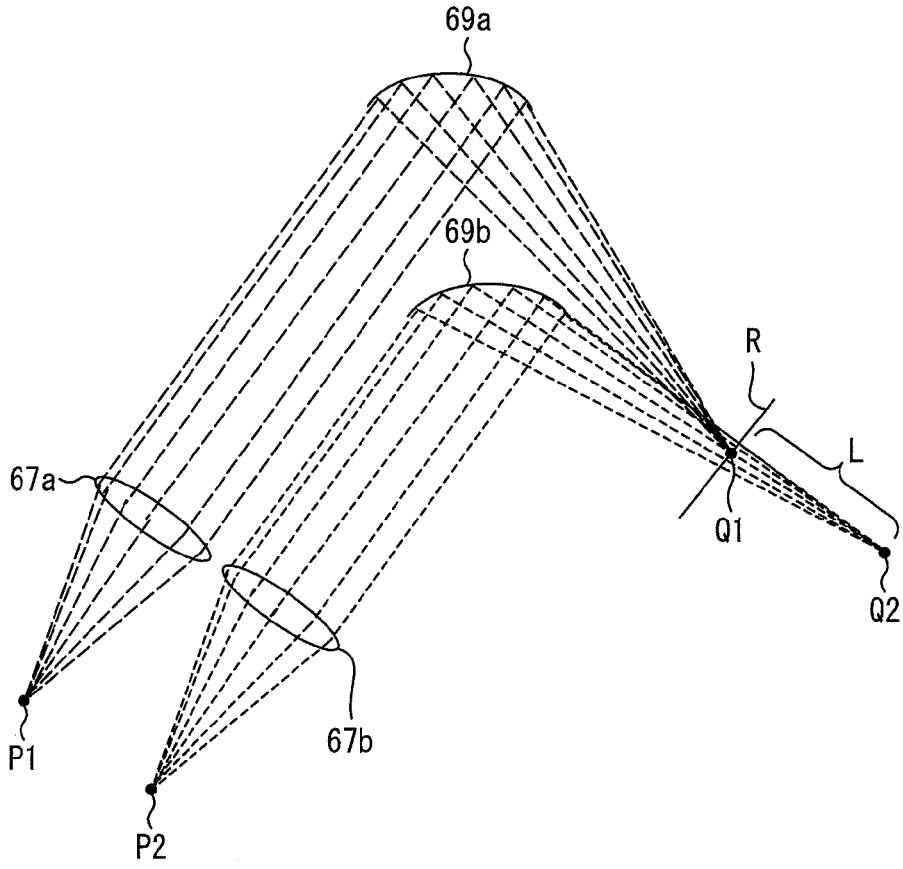
FIG. 13 is an explanatory view of an example where a plurality of laser elements are provided respectively with convex lenses and concave mirrors in order to control light intensity distribution of a laser beam on an irradiation surface, wherein the convex lenses convert laser beams, emitted from laser elements, into parallel light and the concave mirrors receive the parallel light as incident light and reflect the incident light toward their respective focal points.

FIG. 13 is an explanatory view of an example where a plurality of laser elements 2 are provided respectively with convex lenses and concave mirrors in order to control light intensity distribution of a laser beam on an irradiation surface, where the convex lenses convert laser beams, emitted from laser elements 2, into parallel light and the concave mirrors receive the parallel light as incident light and reflect the incident light toward their respective focal points. In FIG. 13, the convex lens 67*a* is provided in correspondence with a laser element 2 provided on a position P1, and the convex lens 67*b* is provided in correspondence with a laser element 2 provided on a position P2. Further, the convex lens 67*a* is provided in correspondence with the concave mirror 69*a*, and the convex lens 67*b* is provided in correspondence with the concave mirror 69*b*. Herein, specifications of the convex lens 67*a*, the convex lens 67*b*, the concave mirror 69*a*, and the concave mirror 69*b* are not particularly limited.

As illustrated in FIG. 13, a laser beam of the position P1 is converted into parallel light by entering through the convex lens 67*a*. Then the parallel light is incident on the concave mirror 69*a* and the incident parallel light is reflected from the concave mirror 69*a* toward the converging point Q1. Further, a laser beam of the position P2 is converted into a parallel light by entering through the convex lens 67*b*. Then the parallel light is incident on the concave mirror 69*b* and the incident light is reflected from the concave mirror 69*b* toward the converging point Q2. The light emitting section 4 is placed at an R position, so that the laser beam is converged into the converging point Q1 and the laser beam is converged into the converging point Q2 form light intensity distribution on the irradiation surface of the light emitting section 4.

That is, with the arrangement shown in FIG. 13, a portion corresponding to the focal point of the reflection mirror can be most strongly excited by the laser beam converging upon the converging point Q1. Further, the portion corresponding to the periphery of the focal point can be excited, by a combination of the laser beams converging upon the converging points Q1 and Q2, with intensity being dependent on light intensity distribution of the laser beam on the irradiation surface. Further, a pattern of the light intensity distribution can be appropriately controlled by appropriately changing the positions etc. of the convex lens 67*a*, the convex lens 67*b*, the concave mirror 69*a*, and the concave mirror 69*b*, the positions of P1 and P2, etc. This makes it possible to desirably control the light-projection pattern of the headlamp.

So far, the arrangements each for controlling the light intensity distribution of the laser beam on the irradiation surface of the light emitting section 4 have been described with reference to FIGS. 7 to 13. It should be noted that the headlamp 1 etc. may be accomplished by including one or a combination of control means for controlling light intensity distribution illustrated in FIGS. 7 to 13 or by including control means other than the arrangements illustrated in FIGS. 7 to 13. By controlling light intensity distribution of excitation light in accordance with a usage state etc. of the headlamp 1 etc., an arbitrary light-projection pattern can be accomplished.

EXAMPLES

Next, more specific examples will be described with reference to FIGS. 14 to 16. Note that members same as members described in the aforementioned embodiment are denoted by the like symbols and description thereof is not repeated here. Further, materials, forms, and various kinds of numeral values are merely examples, and therefore these materials, shapes, and various kinds of numeral values do not limit the present invention.

Example 1

Figure 14:
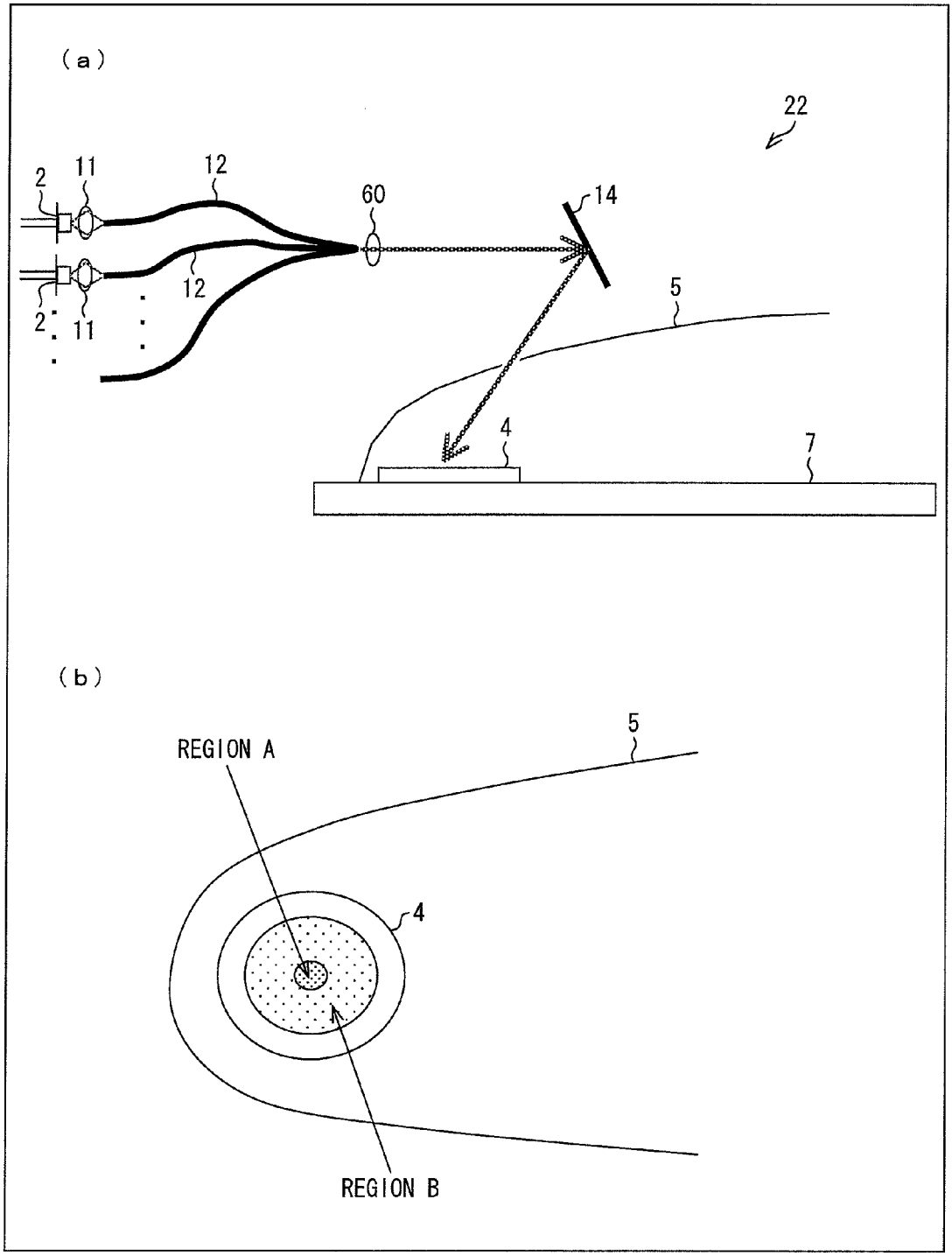
FIG. 14 are schematic views of a headlamp according to an example of the present invention: (*a*) of FIG. 14 is a side view; and (*b*) of FIG. 14 is a top view.

FIG. 14 is schematic view of a headlamp 22 according to an example of the present invention. (*a*) of FIG. 14 is a side view of the headlamp 22, and (*b*) of FIG. 14 is a top view thereof. As illustrated in FIG. 14, the head lamp 22 includes a plurality of sets of laser elements 2 and converging lenses 11, a plurality of optical fibers 12, a compound lens 60 (see FIG. 7), a reflection mirror 14, a light emitting section 4, a parabolic mirror 5, and a metal base 7.

The converging lens 11 is a lens that causes a laser beam emitted from a laser element 2 to enter into an entrance end section as one end of an optical fiber 12. The plurality of sets of laser elements 2 and converging lenses 11 have one-to-one correspondence with the plurality of optical fibers 12. That is, the laser elements 2 are optically connected to the optical fibers 12 via the converging lenses 11, respectively.

Each of the optical fibers 12 serves as a light guide member for guiding, to the light emitting section 4, a laser beam emitted from the laser element 2. The optical fiber 12 has a double-layered structure in which a center core is coated with a clad having a refractive index lower than that of the core. A laser beam incident on the entrance end section passes through the inside of the optical fiber 12, and emits from the other end as an emission end section of the optical fiber 12. The emission end sections of the optical fibers 12 are bundled together by a ferrule or the like.

Light intensity distribution of the laser beam that has been emitted from the emission end section of the optical fiber 12 is controlled by the compound lens 60, and then, the laser beam reflects on the reflection mirror 14. This reflection changes a path of the laser beam, and thereafter, the laser beam is guided to the light emitting section 4 through a window section 6 of the parabolic mirror 5.

Note that the compound lens 60 may be configured similarly to the arrangements illustrated in FIGS. 8 to 13. The same applies to an arrangement of a compound lens 60 of an example that will be described with reference to FIGS. 15 and 16.

(Detail of Laser Element 2)

The laser element 2 is an element with 1 W output for emitting a laser beam having a wavelength of 405 nm, and in this example, ten laser elements 2 are provided. Therefore, gross output of laser beams is 10 W.

(Detail of Light Emitting Section 4)

In the light emitting section 4, three kinds of fluorescent materials (for example, RGB fluorescent materials) are mixed so as to emit white light. For example, the red (R) fluorescent material may be $CaAlSiN_3$:Eu, the green (G) fluorescent material may be β-SiAlON:Eu, and the blue (B) fluorescent material may be $(BaSr)MgAl_{10}O_{17}$:Eu.

By way of example, the light emitting section 4 has a disc-like shape having a diameter of 2 mm and a thickness of 0.2 mm. The light emitting section 4 is made in such a manner that powders of the fluorescent materials are sintered and then hardened.

The light emitting section 4 is placed so that (i) a focal point of the parabolic mirror 5 and a periphery of the focal point are positioned on the light emitting section 4 and (ii) the light emitting section 4 is most strongly excited at a portion corresponding to the focal point, meanwhile, at a portion corresponding to the focal point, the light emitting section 4 is excited with intensity being dependent on light intensity distribution of the laser beam on the irradiation surface.

(Detail of Metal Base 7)

The metal base 7 is made of copper, and aluminum is deposited on a surface of the metal base 7 on which the light emitting section 4 is to be placed. Note that the metal base 7 may be made of iron or the like.

(Effect of Headlamp 22)

(*b*) of FIG. 14 is a top view of the headlamp 22, and illustrates a state in which the light emitting section 4 is excited by a laser beam. In (*b*) of FIG. 14, a region A on the irradiation surface has the portion corresponding to the focal point of the parabolic mirror 5, and is strongly excited by a laser beam. A region B has the portion corresponding to the periphery of the focal point of the parabolic mirror 5, and is irradiated with light having a relatively lower intensity than the case of the region A.

As illustrated in (*b*) of FIG. 14, the compound lens 60 controls light intensity distribution of a laser beam in the headlamp 22, so that the region A of the irradiation surface is excited with light having a high intensity, and the region B of the irradiation surface is excited with light having a low intensity. This results in controlling a light-projection pattern of light emitted from the headlamp 22.

Further, in the case where a half parabolic mirror 5 is used in the headlamp 22, a range in which uncontrollable stray light of fluorescence reflected on the parabolic mirror 5 is emitted is different between a parabolic side of the parabolic mirror 5 and the non-parabolic side thereof. The range in which the uncontrollable stray light is projected is larger on the parabolic side of the parabolic mirror 5 than on the other side. When the headlamp 22 is used as a vehicle headlamp in such a manner that the parabolic side of the parabolic mirror 5 is placed downward on a road side, this feature allows the headlamp 22 to appropriately project light on the parabolic side (road side) of the parabolic mirror 5 while projecting light toward a due forward direction of a vehicle with enough bright. This improves safety of driving.

Furthermore, in the case where the half parabolic mirror 5 is used in the headlamp 22, the light-projection pattern can be changed in accordance with a thickness of the light emitting section 4 in a direction perpendicular to the irradiation surface. Specifically, thickening the thickness of the light emitting section 4 can provide a more circle light-projection pattern, and thinning the thickness of the light emitting section 4 can provide a more ellipsoid-shaped light-projection pattern. As described above, the headlamp 22 has an effect of changing the light-projection pattern by changing the thickness of the light emitting section 4.

Example 2

Figure 15:
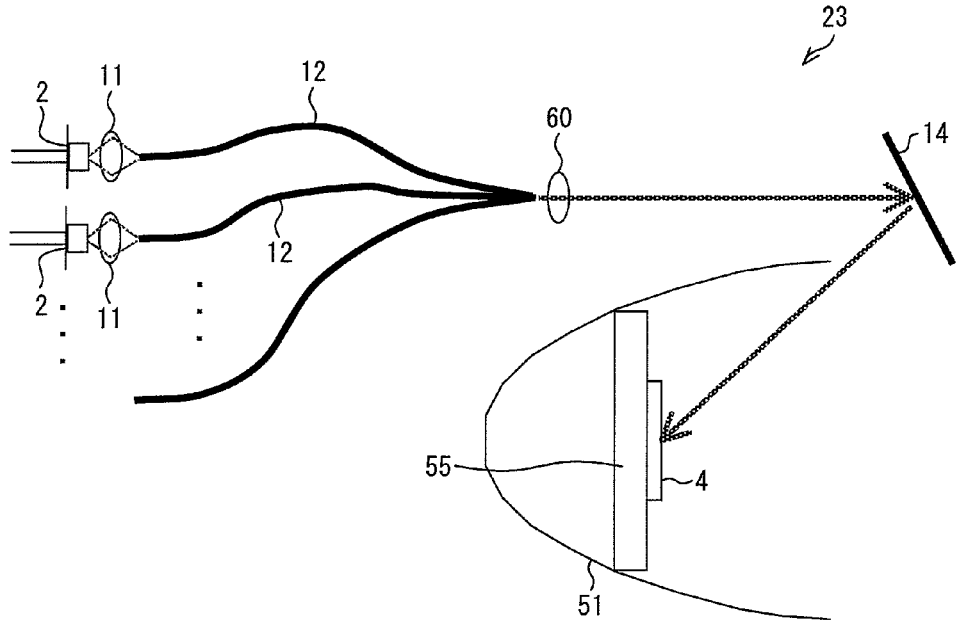
FIG. 15 is a schematic view of a headlamp according to another example of the present invention.

FIG. 15 is a schematic view of a headlamp 23 according to another example of the present invention. As illustrated in FIG. 15, the head lamp 23 includes a plurality of sets of laser elements 2 and converging lenses 11, a plurality of optical fibers 12, a compound lens 60, a reflection mirror 14, a light emitting section 4, a glass plate 55, and a circular parabolic mirror 51.

Example 2 is very different from Example 1 in that, in the headlamp 23, the light emitting section 4 is applied on the transparent glass plate 55 which is placed so as to inscribe in the inside of the circle parabolic mirror 51. Further, because the headlamp 23 includes the circle parabolic mirror 51, Example 2 has an effect that a light-projection pattern can be controlled easily by the shape of the light emitting section 4, rather than by thickness of the light emitting section 4. For example, when using an ellipsoid-shaped light emitting section 4 (i.e., a fluorescent material having a wide-width irradiation surface), an ellipsoid-shaped light-projection pattern can be accomplished.

Example 3

Figure 16:
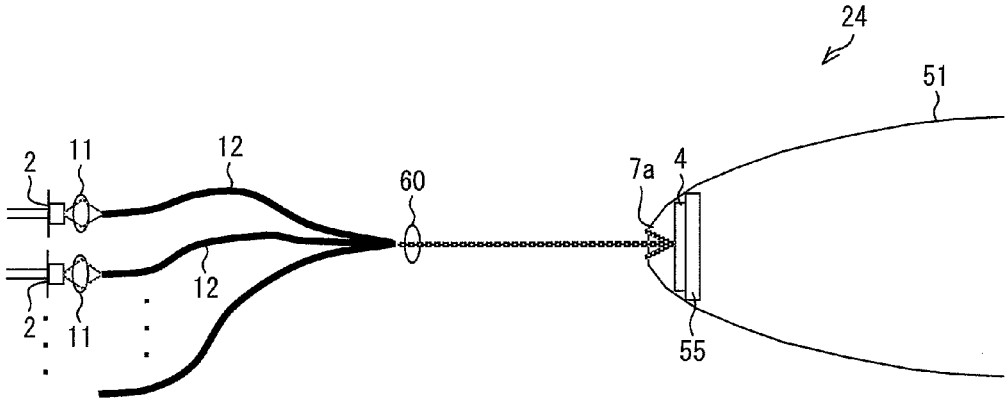
FIG. 16 is a schematic view of a headlamp according to another example of the present invention.

FIG. 16 is a schematic view of a headlamp 24 according to another example of the present invention. As illustrated in FIG. 16, the head lamp 24 includes a plurality of sets of laser elements 2 and converging lenses 11, a plurality of optical fibers 12, a compound lens 60, a light emitting section 4, a glass plate 55, and a circle parabolic mirror 51.

In the headlamp 24, an opening 51*a* is provided on a peak portion of the circle parabolic mirror 51, and a laser beam through the opening 51*a* irradiates the light emitting section 4 placed to face the opening 51*a*, thereby irradiating the light emitting section 4 from its backside (i.e., from a surface opposite to a surface attached to the glass plate 55).

The reflection mirrors 14 for use in Example 1 and Example 2 is unnecessary, and therefore the headlamp 24 has effects of reducing producing cost and improving a freedom of design.

[Effect(S) Obtained by Headlamp 1 Etc.]

Effect(s) obtained by the headlamp 1 etc. will be described below.

The headlamp 1 etc. includes a laser element 2 for emitting a light beam; a light emitting section 4 for emitting fluorescence by receiving the laser beam emitted from the laser element 2; and a parabolic mirror 5 for projecting the fluorescence emitted from the light emitting section 4. The light emitting section 4 is placed so that a focal point of the parabolic mirror 5 and a periphery of the focal point are positioned on the light emitting section 4. The light emitting section 4 is most strongly excited at a portion corresponding to the focal point of the parabolic mirror 5, and the light emitting section 4 is excited with intensity being dependent on light intensity distribution of the of the laser beam on an irradiation surface of the light emitting section.

According the aforementioned arrangement, the light emitting section 4 is placed so that the focal point of the parabolic mirror 5 and the periphery of the focal point are positioned on the light emitting section 4. In addition, the light emitting section 4 is most strongly excited at a portion corresponding to the focal point, meanwhile, at the portion of the light emitting section 4, which portion corresponds to the periphery of the focal point, is excited with intensity being dependent on light intensity distribution of the laser beam on the irradiation surface.

The light emitting section 4 is most strongly excited at a portion corresponding to the focal point of the parabolic mirror 5 as described above. The fluorescence emitted from the portion is reflected on the parabolic mirror 5, and hence the light emitting section can brightly illuminate a due forward direction of the vehicle with a narrow solid angle.

Further, the light emitting section 4 is most strongly excited at the portion corresponding to the focal point, meanwhile, at the portion of the light emitting section 4, which portion corresponds to the periphery of the focal point, is excited with intensity being dependent on light intensity distribution of the laser beam on the irradiation surface. The fluorescence emitted from the portion is reflected on the parabolic mirror 5, and therefore the light emitting section can appropriately illuminate the vicinity of the due forward direction of the vehicle with a wide solid angle. In addition, a light-projection pattern of a target to be illuminated with light can be arbitrarily changed by applying the light intensity distribution of the laser beam in accordance with a use for or a usage state of the headlamp. That is, the headlamp 1 etc. can achieve the problem as a conventional problem that light-projection is accomplished only under such a limited light-distribution state that the portion corresponding to the periphery of the focal point is not irradiated with a laser beam and only the part corresponding to the focal point is irradiated with the laser beam.

As described above, the headlamp 1 etc. can accomplish an arbitrary light-projection pattern in accordance with a use for or a usage state of the headlamp, and therefore the light emitting device can be much convenient for a user in comparison with conventional headlamps.

Furthermore, in the headlamp 1 etc., the light intensity distribution of the laser beam may be controlled to control a light-projection pattern of light emitted from the headlamp 1.

According to this arrangement, in order to control the light-projection pattern of the light emitted from the headlamp 1, the light intensity distribution of the excitation light only needs to be controlled and any additional arrangement is unnecessary. Therefore the light emitting device can be accomplished with a simple structure.

Furthermore, the headlamp 1 etc. may include light intensity distribution control means for controlling the light intensity distribution of the laser beam emitted from the laser element 2.

According to this arrangement, the headlamp 1 etc. includes the compound lens 60 etc. The compound lens 60 etc. is only required to control the light intensity distribution of the laser beam in accordance with a use for and a usage state of the headlamp 1 etc., and therefore an arbitrary light-projection pattern can be provided to a user.

Further, the arrangement of the compound lens 60 etc. may be appropriately decided in accordance with a size, a shape, and the like of the headlamp 1 etc. This can improve a freedom of design of the headlamp 1 etc.

Furthermore, in the headlamp 1 etc., the parabolic mirror 5 may include at least a part of a partially curved-surface which has a shape obtainable by cutting off a curved surface formed by rotating a parabola about a symmetric symmetric axis (i.e., a rotation axis) of the parabola, the cutting off being cutting along a plane including the rotation axis.

At least a part of the parabolic mirror 5 is paraboloid, and hence fluorescence from the light emitting section 4 can be effectively projected within a predetermined solid angle. This can improve use efficiency of fluorescence.

In the case where a half parabolic mirror 5 (i.e., a half of a parabolic mirror has a parabolic shape and the other half thereof is a structure other than a parabolic mirror (e.g., reflection plate), for example, a range in which uncontrollable stray light of fluorescence reflected on the parabolic mirror 5 is emitted is different between a parabolic side of the parabolic mirror 5 and the other side thereof. Specifically, the range in which the uncontrollable stray light is projected is larger on the parabolic side of the parabolic mirror 5 than on the other side. Therefore, by using this feature, the parabolic side of the parabolic mirror 5 can be appropriately illuminated.

With this, the headlamp 1 etc. can accomplish more various light-projection patterns in accordance with its usage state.

Note that, in the aforementioned arrangement, the light-projection pattern can be changed in accordance with a thickness of the light emitting section 4 in a direction perpendicular to the irradiation surface. Specifically, thickening the thickness of the light emitting section 4 can provide a more circle light-projection pattern, and thinning the thickness of the light emitting section 4 can provide a more ellipsoid-shaped light-projection pattern.

Further, in the headlamp 1 etc., the parabolic mirror may include at least a part of a curved surface formed by rotating a circle, ellipse, or parabola about a symmetric axis of the circle, ellipse, or parabola as a rotation axis.

The aforementioned arrangement has an effect that a light-projection pattern can be controlled easily by the shape of the light emitting section 4, rather than by thickness of the light emitting section 4. For example, when using an ellipsoid-shaped fluorescent material (i.e., a fluorescent material having a wide-width irradiation surface), an ellipsoid-shaped light-projection pattern can be accomplished.

The headlamp 1 etc. can be suitably used as a vehicle headlamp or an illumination device. In the case where the headlamp 1 etc. is used as a vehicle headlamp, for example, the vehicle headlamp can accomplish a light-projection pattern in accordance with a driving state of the vehicle. Therefore the vehicle headlamp can be more convenient for a user.

Further, an automobile 10 includes a vehicle headlamp, the vehicle headlamp including: a laser element 2 for emitting a laser beam; a light emitting section 4 for emitting fluorescence by receiving the laser beam emitted from the laser element 2; a parabolic mirror 5 having a reflecting curved-surface for reflecting the fluorescence emitted from the light emitting section 4; and a support having a surface that faces the reflecting curved-surface, the support supporting the light emitting section 4, the vehicle headlamp being provided in the automobile 10 so that the reflecting curved-surface is positioned on a lower side of the vehicle headlamp in the vertical direction.

In a state in which the vehicle headlamp is provided in the automobile 10, the parabolic mirror 5 having the reflecting curved-surface is positioned on the lower side of the vehicle headlamp in the vertical direction and the support is positioned on the upper side thereof in the vertical direction, and hence fluorescence which has been emitted from the light emitting section 4 and could not have been controlled by the parabolic mirror 5 is projected more on a side of the parabolic mirror 5 of the vehicle headlamp, i.e., the lower side of the parabolic mirror 5 in the vertical direction. Therefore the vehicle headlamp can illuminate far (due forward direction of the automobile 10) with light controlled by the parabolic mirror 5, and in addition, can illuminate the vicinity of and downward the automobile 10 with the fluorescence which could not have been controlled by the parabolic mirror 5. Accordingly the fluorescence which could not have been controlled by the parabolic mirror 5 can be used effectively, and the vehicle headlamp can extend an illumination range of the vehicle headlamp while brightly illuminating the due forward direction of the automobile 10.

OTHER EMBODIMENTS

Figure 17:
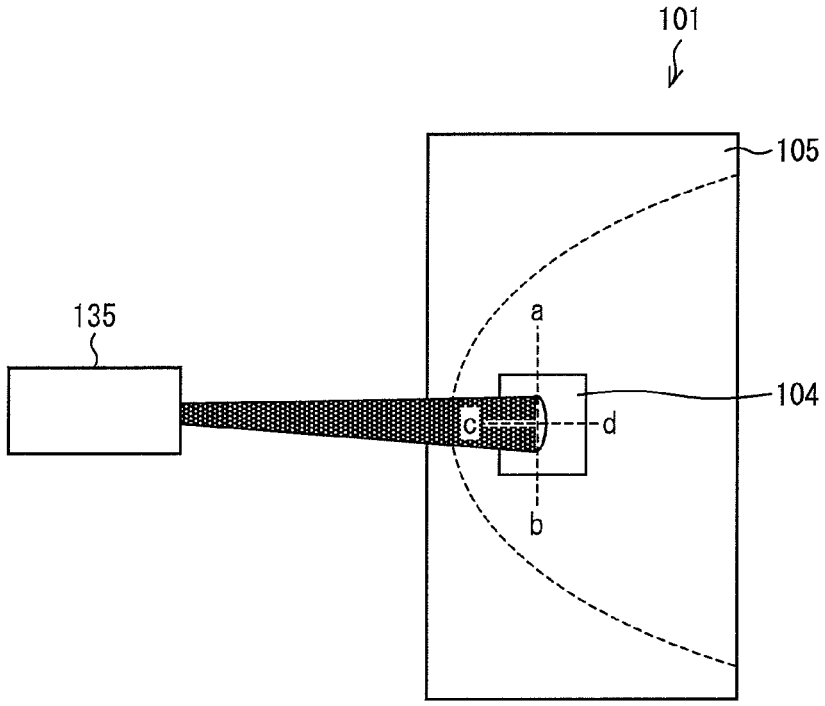
FIG. 17 illustrates a modification of FIG. 5.

FIG. 17 illustrates a modification a light-projection pattern of FIG. 5, and is an example where a headlamp 101 used as a vehicle headlamp projects light in an ellipsoid shape toward a road.

As illustrated in FIG. 17, when two segments orthogonal to each other on a light emitting section 104 are denoted by an a-b line and a c-d line, the light emitting section 104 is positioned so that a focal point of a parabolic mirror 105 is positioned at an intersection of the a-b line and the c-d line. Further, a laser beam source unit 135 most strongly excites a portion of the light emitting section 104, which portion corresponds to the focal point of the parabolic mirror 105, and excites a portion corresponding to a periphery of the focal point with intensity being dependent on light intensity distribution of a laser beam.

Figure 19:
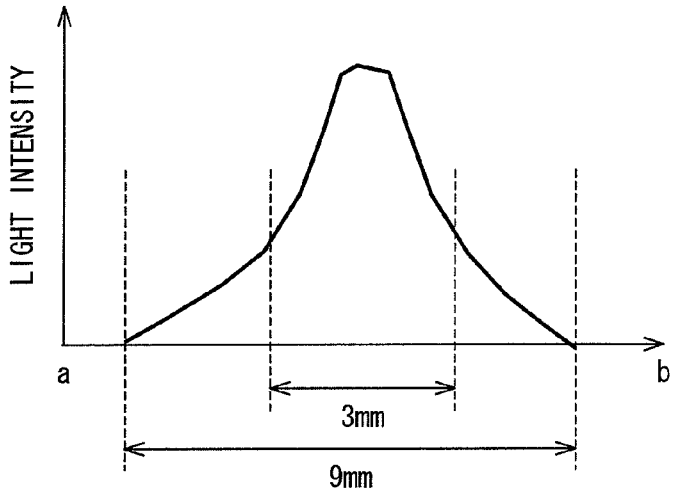
FIG. 19 illustrates an example of light intensity distribution of a laser beam in an a-b direction of FIG. 17.
Figure 20:
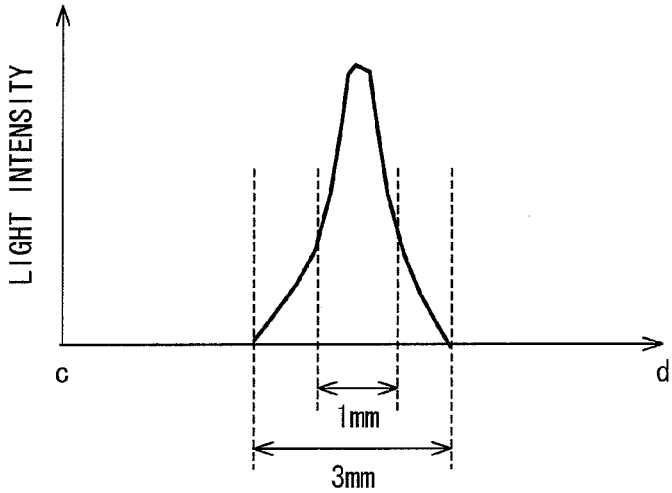
FIG. 20 illustrates an example of light intensity distribution of a laser beam in a c-d direction of FIG. 17.

Specific description of this will be made with reference to FIGS. 19 and 20. FIG. 19 illustrates an example of the light intensity distribution of the laser beam on the a-b line (i.e., in an a-b direction) of FIG. 17. FIG. 20 illustrates an example of the light intensity distribution of the laser beam on the c-d line (i.e., in a c-d direction) of FIG. 17.

As illustrated in FIG. 19, the laser beam source unit 135 irradiates a light irradiation region defined by a range of 3 mm in the a-b direction of FIG. 17 with a laser beam having high light intensity, and irradiates 3-mm periphery of the light irradiation region along the a-b direction with a laser beam having weak light intensity. Furthermore, as illustrated in FIG. 20, the laser beam source unit 135 irradiates a light irradiation region defined by a range of 1 mm in the c-d direction of FIG. 17 with a laser beam having high light intensity, and irradiates 1-mm periphery of the light irradiation region along the c-d direction with a laser beam having low light intensity. That is, the entire light irradiation region and the region irradiated with light having high light intensity may be wider in the a-b direction than the regions in the c-d direction by three times or more.

Figure 18:
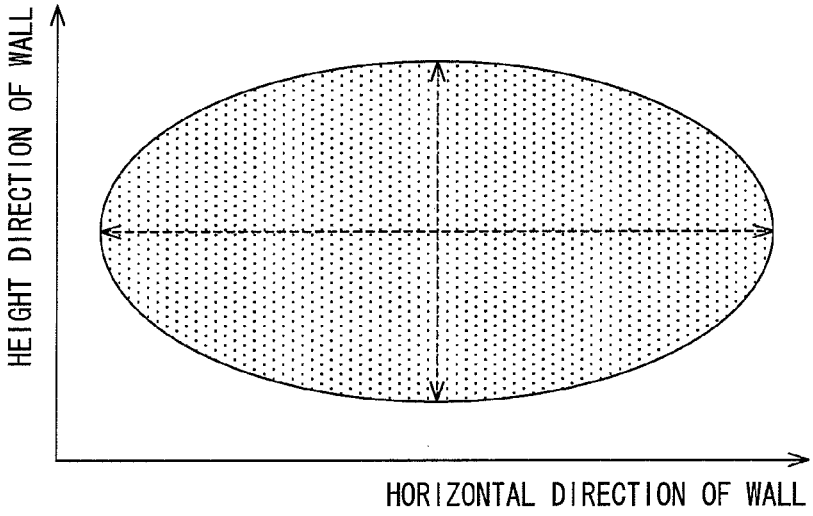
FIG. 18 illustrates an example of a light-projection image that reflects on a wall when a headlamp of FIG. 17 projects light toward the wall.

When the laser beam is irradiated with the light emitting section 104 as described above, light-projection illustrated in FIG. 18 can be obtained. FIG. 18 illustrates an example of a light-projection image that reflects on a wall when the headlamp 101 of FIG. 17 projects light toward the wall. FIG. 18 illustrates a light-projection pattern of light obtained when a longitudinal direction of the figure is a height direction and a latitudinal direction of the figure is the horizontal direction of a wall. As illustrated in FIG. 18, the ellipsoid light-projection pattern having a ratio of height to horizontal width of about 1:3 is projected toward the wall. This light-projection pattern can be obtained by exciting the light emitting section 104 with use of a laser beam having the light intensity distribution of FIGS. 17 and 18.

Note that numeral ranges shown in FIGS. 19 and 20 are merely examples, and therefore are not limited to numerals shown in FIGS. 19 and 20. Therefore, even if the light-projection pattern has an ellipsoid shape, the ratio of height to horizontal width is not limited to 1:3. However, in the case where the headlamp 101 is used as a vehicle headlamp, the ratio of height to horizontal width preferably falls within the range of 1:3 to 1:4. This will be described with reference to FIG. 21.

Figure 21:
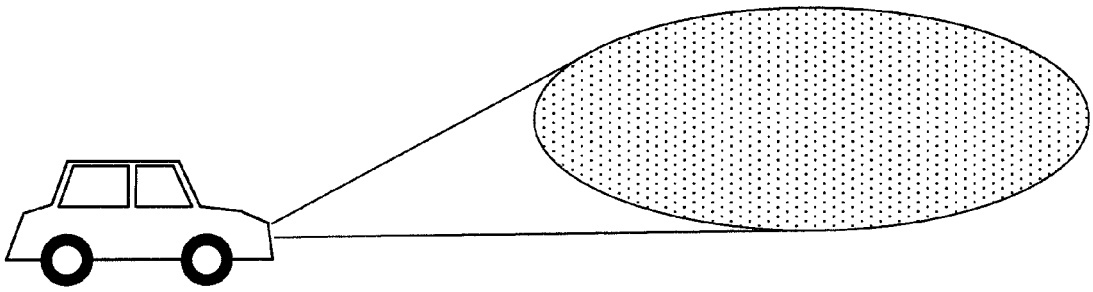
FIG. 21 is a schematic view illustrating a light-projection pattern in the case of using as a vehicle headlamp a headlamp according to an embodiment of the present invention.

FIG. 21 is a schematic view illustrating a light-projection pattern in the case of using the headlamp 101 as a vehicle headlamp. For the vehicle headlamp, an ellipsoid light-projection pattern is a necessary shape for effectively illuminating a center of a road, sidewalks on both sides, road signs, etc. If the aforementioned ratio is too small, the sidewalks or the road signs are not illuminated enough. If the aforementioned ratio is too large, the sidewalks or the road signs are illuminated too much. Because of this, in the case where the headlamp 101 is used as a vehicle headlamp, the headlamp 101 preferably has an ellipse having a ratio of height to horizontal width with in the range of 1:3 to 1:4.

[Cylindrical Lens]

Figure 22:
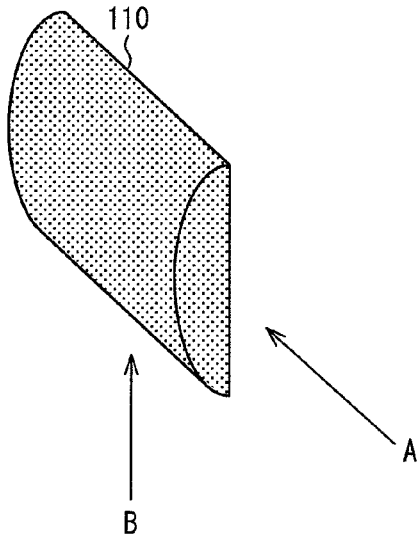
FIG. 22 is a perspective view of a cylindrical lens.

Next, a method etc. for controlling a laser beam to have an desirable ellipse will be described with reference to FIG. 22 etc. FIG. 22 is a perspective view of a cylindrical lens 110. A cylindrical lens is known as a lens capable of changing angles of light rays (changing magnification of an image) along only one direction. In FIG. 22, the arrow B indicates a height direction and the arrow A indicates the horizontal direction which is perpendicular to the arrow B.

Figure 23:
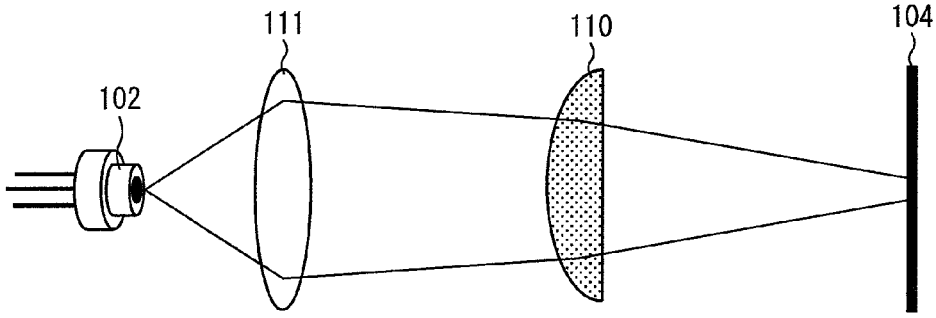
FIG. 23 illustrates an optical path inside a laser beam source unit when seeing in an A direction (horizontal direction).
Figure 24:
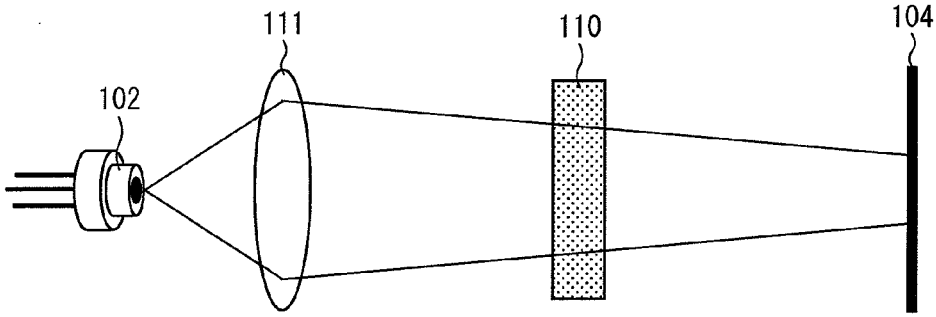
FIG. 24 illustrates an optical path inside a laser beam source unit when seeing in a B direction (height direction).

A method for projecting an ellipsoid laser beam toward a light emitting section 104 with use of the cylindrical lens 110 will be described with reference to FIGS. 23 and 24. FIG. 23 illustrates an optical path inside a laser beam source unit when seeing in the A direction (horizontal direction). FIG. 24 illustrates an optical path inside a laser beam source unit when seeing in the B direction (height direction).

Herein, a laser element 102, a converging lens 111, and the cylindrical lens 110 are provided in this order in the laser beam source unit. A laser beam emitted from the laser element 102 is irradiated with the light emitting section 104 through the converging lens 111 and the cylindrical lens 110.

As illustrated in FIG. 23, when seeing the optical path in the A direction (horizontal direction) at this time, the laser beam converged by the converging lens 111 is further converged by the cylindrical lens 110. That is, the laser beam can be converged more by the cylindrical lens 110 along the height direction in comparison with the case of not using the cylindrical lens 110.

Meanwhile, when seeing the optical path in the B direction (height direction) as illustrated in FIG. 24, the laser beam converged by the converging lens 111 reaches the light emitting section 104 without being converged by the cylindrical lens 110. That is, even if the cylindrical lens 110 is used, a concentration ratio along the horizontal direction is rarely changed.

Using the cylindrical lens 110 as described above can accomplish an arrangement in which a laser beam is converged along the height direction and is rarely converged along the horizontal direction. As a result, an aspect ratio of a spot shape of the laser beam on the light emitting section 104 can be arbitrarily changed, that is, the laser beam can be controlled to have a desired ellipsoid shape.

Note that means for controlling a laser beam to have a desired ellipsoid shape is not limited to the combination of the converging lens and the cylindrical lens. For example, an ellipsoid convex lens for guiding a laser beam into the light emitting section 104 by transmitting the laser beam through this convex lens can also control the laser beam to have a desired ellipsoid shape.

[Arrangement of Light-Projection with Use of Convex Lens]

Figure 25:
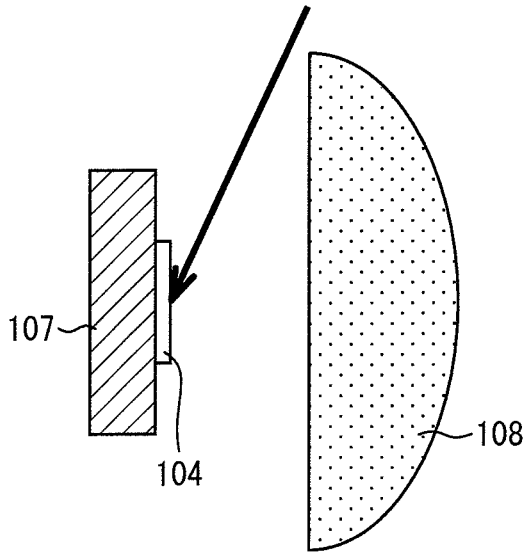
FIG. 25 illustrates an arrangement in which a convex lens is used for irradiating an outside of a headlamp with fluorescence emitted from a light emitting section.

Next, instead of a parabolic mirror, an arrangement in which light is projected with a convex lens will be described with reference to FIG. 25. FIG. 25 illustrates an arrangement in which a convex lens 108 is used for projecting, to an outside of a headlamp, fluorescence emitted from a light emitting section 104.

In order to project, to the outside of the headlamp, fluorescence emitted from the light emitting section 104, the convex lens 108 is used in a headlamp according to this embodiment instead of a parabolic mirror 5. The light emitting section 104 is placed so that a focal point of the convex lens 108 is positioned on the light emitting section 104. Further, the light emitting section 104 is most strongly excited at a portion corresponding to the focal point of the convex lens 108, meanwhile, at a portion corresponding to the periphery of the focal point, the light emitting section is excited with intensity being dependent on light intensity distribution of a laser beam on the irradiation surface of the light emitting section 104.

In this arrangement, fluorescence that is emitted, from the light emitting section 104, by irradiation of a laser beam has the most high light-intensity in a vertical direction with respect to an irradiation surface irradiated with the laser beam. Therefore, by placing the convex lens 108 in the vertical direction, the fluorescence can be efficiently converged, and in addition, the fluorescence thus converged can be efficiently projected to the outside of the headlamp.

Figure 26:
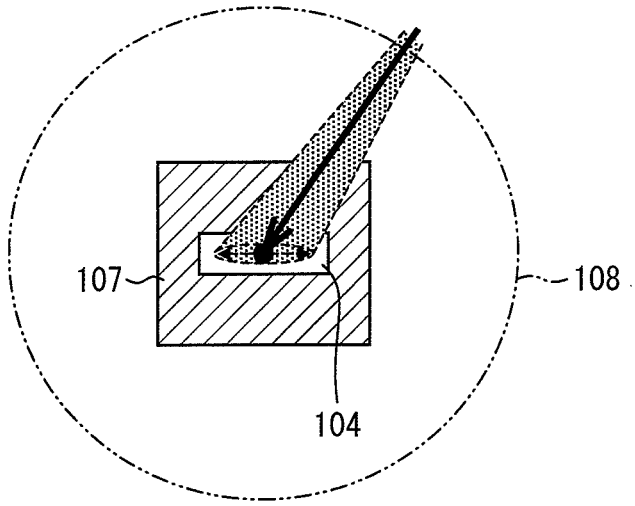
FIG. 26 illustrates a state in which the arrangement of FIG. 25 is seen from above an irradiation surface of the arrangement.

Note that, for reference, FIG. 26 illustrates a state in which the arrangement of FIG. 25 is seen in the vertical direction with respect to the irradiation surface. In FIG. 26, for the sake of easy illustration, the convex lens 108 is illustrated by a dotted line, and the light emitting section 104 and a metal base 107 are illustrated with a solid line. As illustrated in FIG. 26, the light emitting section 104 is irradiated with a laser beam having an ellipsoid shape. A position defined by a block dot of FIG. 26 is the focal point of the convex lens 108.

Note that the aforementioned arrangements may be appropriately used as to the number of laser elements, a method of bundling of emission end sections of optical fibers, a method for obtaining a parallel beam, control of a laser-spot shape, etc. Further, the arrangements may be appropriately used in combination for determining output and a wavelength of a laser beam, fluorescent material, etc.

Further, as described above, the light emitting section 104 is most strongly excited at a portion corresponding to the focal point of the convex lens 108, meanwhile, at a portion corresponding to the periphery of the focal point, the light emitting section is excited with intensity being dependent on light intensity distribution of a laser beam on the irradiation surface of the light emitting section 104.

Figure 27:
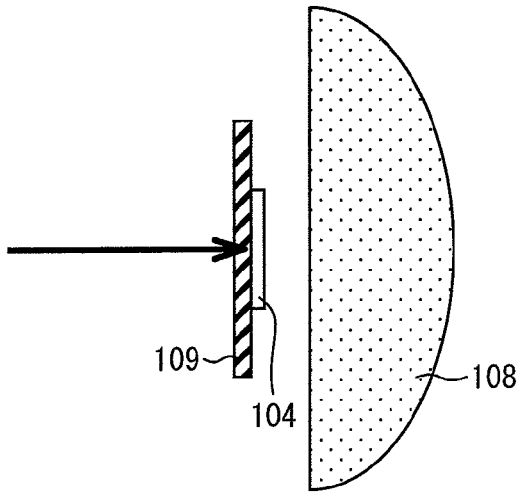
FIG. 27 illustrates another arrangement in which a convex lens is used for irradiating an outside of a headlamp with fluorescence emitted from a light emitting section.
Figure 28:
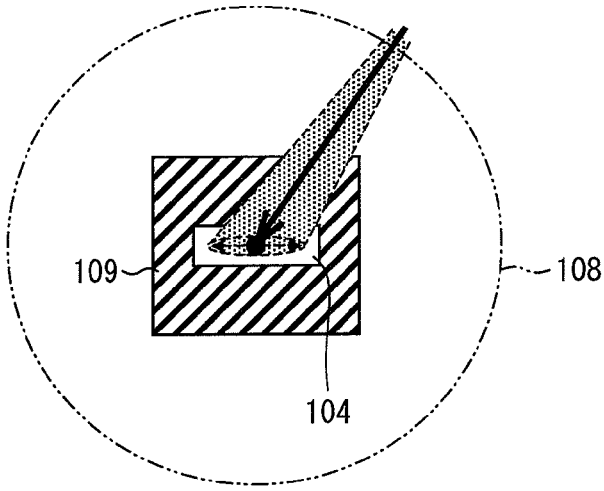
FIG. 28 illustrates a state in which the arrangement of FIG. 27 is seen from above an irradiation surface of the arrangement.

Next, instead of a parabolic mirror, an arrangement in which light is projected with a convex lens will be described with reference to FIG. 27. FIG. 27 illustrates another state in which the convex lens 108 is used for projecting, to an outside of a headlamp, fluorescence emitted from a light emitting section 104. Note that, in FIG. 27, a glass plate 109 is provided in place of the metal base 107 of FIG. 26. Further, the light emitting section 104 is irradiated with a laser beam traveling from behind the glass plate 109 toward the convex lens 108. For reference, FIG. 28 illustrates a state in which the arrangement of FIG. 27 is seen in a vertical direction with respect to the irradiation surface. This arrangement can obtain an effect which is the same as that of the headlamp illustrated in FIG. 25.

As is apparent from FIGS. 25 to 28, light-projection with use of the convex lens can be accomplished by various arrangements. Therefore, even if an attaching position of a laser element with respect to a light emitting section is limited, for example, light-projection with use of the convex lens can be accomplished by various arrangements in accordance with designing conditions. That is, the headlamp according to this embodiment can be provided to a user as a device having high freedom of design.

[Arrangement of Light-Projection with Use of Parabolic Mirror and Lens]

Figure 29:
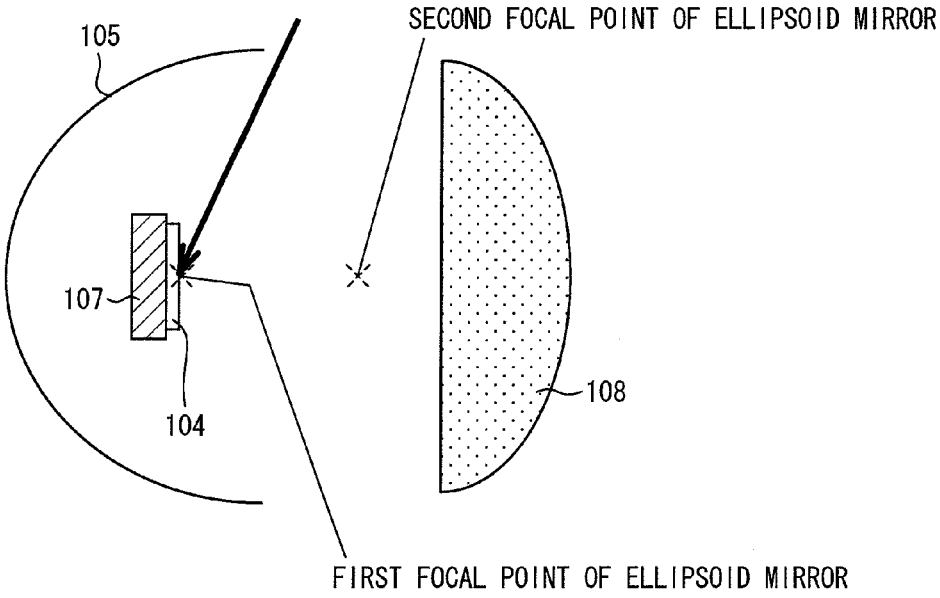
FIG. 29 illustrates an arrangement in which a parabolic mirror and a convex lens are used for irradiating an outside of a headlamp with fluorescence emitted from a light emitting section.

Next, an arrangement of light-projection with use of a parabolic mirror 105 and a convex lens 108 will be described with reference to FIG. 29. FIG. 29 illustrates an arrangement in which the parabolic mirror 105 and the convex lens 108 are used for irradiating an outside of a headlamp with fluorescence emitted from the light emitting section 104.

The headlamp of FIG. 29 includes at least a light emitting section 104, the parabolic mirror 105, a metal base 107, and the convex lens 108.

The light emitting section 104 is attached to the metal base 107 and is placed so that the first focal point is positioned on the light emitting section 104. Further, the light emitting section 104 is most strongly excited at a portion corresponding to the first focal point of the parabolic mirror 105, meanwhile at a portion corresponding to a periphery of the focal point, the light emitting section is excited with intensity being dependent on light intensity distribution of a laser beam on the irradiation surface of the light emitting section 104.

Figure 30:
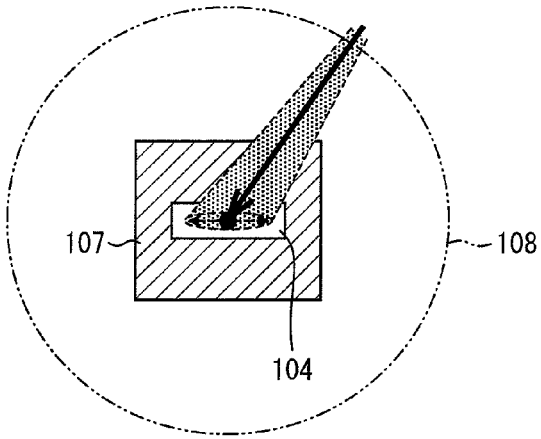
FIG. 30 illustrates a state in which the arrangement of FIG. 29 is seen from above an irradiation surface of the arrangement.

The convex lens 108 is provided so that a focal point of the convex lens 108 is positioned at a second focal point of the parabolic mirror 105. It can be assumed that the light emitting section 104 of FIG. 25 exists on the focal position of the convex lens 108, i.e., an imaginary light source exists on the focal position of the convex lens 108 and the imaginary light source emits light. For reference, FIG. 30 illustrates a state in which the arrangement of FIG. 29 is seen from above the irradiation surface of the arrangement. With this arrangement, an effect same as that of the headlamp illustrated in FIG. 29 can be obtained.

As described above, the light emitting section 104, the parabolic mirror 105, the metal base 107, and the convex lens 108 are provided with the aforementioned positioning relationship. Therefore fluorescence can be efficiently converged, and in addition, the fluorescence thus converged can be efficiently projected to the outside of the headlamp.

In order to attain the object, a light emitting device according to the present invention includes: an excitation light source for emitting excitation light; a light emitting section for emitting fluorescence by receiving the excitation light emitted from the excitation light source; and a reflection mirror for reflecting the fluorescence emitted from the light emitting section, the light emitting section being placed so that a focal point of the reflection mirror and a periphery of the focal point are positioned on the light emitting section, the light emitting section being most strongly excited at a portion corresponding to the focal point, meanwhile, at a portion corresponding to the periphery of the focal point, the light emitting section being excited with intensity being dependent on light intensity distribution of the excitation light on an irradiation surface of the light emitting section.

According to this arrangement, the light emitting section is placed so that the focal point of the reflection mirror and the periphery of the focal point are positioned on the light emitting section. Further, the light emitting section is most strongly excited at a portion corresponding to the focal point, meanwhile, at a portion corresponding to the periphery of the focal point, the light emitting section is excited with intensity being dependent on light intensity distribution of the excitation light on an irradiation surface of the light emitting section.

The light emitting section is most strongly excited at a portion corresponding to the focal point of the reflection mirror as described above. The fluorescence emitted from the portion is reflected from the reflection mirror, and hence the light emitting section can brightly illuminate a due forward direction of the light-projecting section with a narrow solid angle.

Further, at the portion corresponding to the periphery of the focal point of the reflection mirror, the light emitting section is excited with intensity being dependent on light intensity distribution of the excitation light on an irradiation surface of the light emitting section. The fluorescence emitted from the portion is reflected from the reflection mirror, and therefore the light emitting section can appropriately illuminate the vicinity of the due forward direction of the light-projecting section with a wide solid angle. In addition, a light-projection pattern of a target to be illuminated with light can be arbitrarily changed by applying the light intensity distribution of the excitation light in accordance with a use for or a usage state of the light emitting device. That is, the light emitting device according to the present invention can solve the conventional problem that light-projection is accomplished only under such a limited light-distribution state that the portion corresponding to the periphery of the focal point is not irradiated with a laser beam and only the portion corresponding to the focal point is irradiated with the laser beam.

As described above, the light emitting device according to the present invention can accomplish an arbitrary light-projection pattern in accordance with a use for or a usage state of the light emitting device, and therefore the light emitting device can be much convenient for a user in comparison with conventional light emitting devices.

[Another Expression of the Present Invention]

The present invention can be also expressed as follows.

Furthermore, in the light emitting device according to the present invention, the light intensity distribution of the excitation light may be controlled to control a light-projection pattern of light emitted from the light emitting device.

According to this arrangement, in order to control the light-projection pattern of the light emitted from the headlamp 1, the light intensity distribution of the excitation light only needs to be controlled and any additional arrangement is unnecessary. Therefore the light emitting device can be accomplished with a simple structure.

Further, according to the light emitting device of the present invention, in the light intensity distribution of the excitation light, light intensity on the portion corresponding to the focal point is the highest, and light intensity on the portion corresponding to the periphery of the focal point is lower than the light intensity on the portion corresponding to the focal point.

According to this arrangement, the light emitting section is most strongly excited at the portion corresponding to the focal point as described above. The fluorescence emitted from the portion is projected from the light-projecting section, and hence the light emitting section can brightly illuminate a due forward direction of the light-projecting section with a narrow solid angle.

Further, at the portion corresponding to the periphery of the focal point, the light emitting section is excited with intensity being dependent on light intensity distribution of the excitation light on an irradiation surface. Therefore, the fluorescence emitted from the portion is projected from the light-projecting section, and hence the light emitting section can appropriately illuminate the vicinity of the due forward direction of the light-projecting section with a wide solid angle.

Furthermore, in the light emitting device according to the present invention, the light intensity distribution of the excitation light is wider in a first direction than in a second direction, where the first direction and the second direction are directions defined on the irradiation surface, and the second direction is vertical to the first direction.

The light emitting device according to the present invention can be used for various uses. The light emitting device according to the present invention is so highly versatile that it can be used as suitable in the various uses.

For example, assume that the case where the light emitting device according to the present invention is used in a vehicle headlamp. The vehicle headlamp is required to efficiently illuminate a center of a road, sidewalks on both sides, road signs, etc. Therefore a light-projection pattern is preferably formed not into a circle but into an ellipse having an ellipsoidal shape long across a driving direction of the vehicle.

Regarding this point, in the light emitting device according to the present invention, the light intensity distribution of the excitation light is wider in a first direction than in a second direction, where the first direction and the second direction are directions defined on the irradiation surface, and the second direction is vertical to the first direction.

With this, when the light emitting device according to the present invention is used in a vehicle headlamp, the light emitting device can efficiently illuminate a center of a road, sidewalks on both sides, road signs, etc. Further, in the case where the light emitting device according to the present invention is used in devices other than the vehicle headlamp, the range of light intensity distribution in the first direction and the range thereof in the second direction can be appropriately changed. In this way, the light emitting device according to the present invention can be suitably used for various uses.

Further, in the light emitting device according to the present invention, the light intensity distribution may be wider in the first direction than in the second direction by three times or more.

According to this arrangement, the light emitting device of the present invention can be suitably used for a vehicle headlamp in particular.

Furthermore, the light emitting device according to the present invention may further include light intensity distribution control means for controlling the light intensity distribution of the excitation light emitted from the excitation light source.

According to this arrangement, the light emitting device of the present invention includes the light intensity distribution control means. The light intensity distribution control means may only control light intensity distribution of the excitation light in accordance with a use for and a usage state of the light emitting device, and therefore an arbitrary light-projection pattern can be provided to a user.

Furthermore, in the light emitting device according to the present invention, the light intensity distribution control means may include a plurality of lenses having respective different optical characteristics.

In the light emitting device according to the present invention, the plurality of lenses having the respective different optical characteristics are used as light intensity distribution control means, so that excitation light emitted from the excitation light source can be converged upon a plurality of converging points. Therefore the light intensity distribution can be formed in the excitation light. Further, because the plurality of lenses having the respective different optical characteristics can be accomplished with an extremely simple arrangement, the light intensity distribution control means for controlling the light intensity distribution of the excitation light emitted from the excitation light source can be accomplished extremely easily in the light emitting device according to the present invention.

Further, in the light emitting device according to the present invention, the light intensity distribution control means may include: a converging lens that causes the excitation light emitted from the excitation light source to converge upon the light emitting section; and an aperture that provides different light transmittances to different paths of the excitation light passed through the converging lens.

By using the aperture that provides different light transmittances depending on paths of the excitation light, light intensity distribution of the excitation light passed through the aperture can be formed on the basis of difference in transmittance. The transmittances of the aperture can be desirably changed. Therefore, in the light emitting device according to the present invention, the light intensity distribution can be formed and controlled desirably by including the aperture that provides the different light transmittances depending on the paths of the excitation light passed through the converging lens or by appropriately changing the transmittances of the aperture.

Furthermore, in the light emitting device according to the present invention, the excitation light source includes a plurality of excitation light sources, the light intensity control means may include a plurality of converging lenses provided respectively to the plurality of excitation light sources, so that each converging lens causes excitation light emitted from a corresponding one of the plurality of excitation light sources to converge upon the light emitting section.

Further, the light emitting device according to the present invention may be arranged such that the plurality of excitation light source are provided respectively with the converging lenses, so that light intensity distribution can be easily formed on the basis of converging points of the excitation light passed through these converging lenses. By changing the converging lenses to be used, the light intensity distribution can be easily changed or/and controlled on the basis of the differences of the optical characteristics of the converging lenses.

Further, in the light emitting device according to the present invention, the light intensity distribution control means may include: a convex lens for converting the excitation light of the excitation light source into parallel light; and a concave mirror for receiving the parallel light as incident light and reflecting the incident light toward two focal points.

By using the concave mirror for reflecting the incident light toward the two focal points, the excitation light emitted from the excitation light source can be converged upon the plurality of converging points. In this way, the light intensity distribution can be formed. Further, by changing the concave mirror to be used, the converging points can be changed, i.e., the light intensity distribution can be controlled. That is, the light intensity distribution of the excitation light emitted from the excitation light source can be easily controlled because the light emitting device according to the present invention includes the convex lens and the concave mirror as described above.

Further, in the light emitting device according to the present invention, light intensity distribution is controlled by reflecting the parallel light on the concave mirror. In the case where the light intensity distribution control means including the converging lens (i.e., an arrangement in which the excitation light source, the converging lens, and the light emitting material are in alignment with one another) cannot be carried out due to a limitation of layout, the light emitting device reflects the parallel light on the concave mirror. As described above, a device layout having high flexibility can be accomplished.

Further, in the light emitting device according to the present invention, the light intensity distribution control means may include: a convex lens for converting the excitation light of the excitation light source into parallel light; a concave mirror for receiving the parallel light as incident light and reflecting the incident light toward one focal point; and an aperture that provides different light transmittances to different paths of the light reflected on the concave mirror.

By using the aperture that provides different light transmittances depending on paths of the excitation light, light intensity distribution of the excitation light passed the aperture can be formed on the basis of difference in transmittances. The transmittances of the aperture can be desirably changed. Therefore, in the light emitting device according to the present invention, the light intensity distribution can be formed and controlled desirably by including the aperture that provides different light transmittances depending on paths of the excitation light or by appropriately changing the transmittance of the aperture.

Further, in the light emitting device according to the present invention, light intensity distribution is controlled by reflecting the parallel light on the concave mirror. In the case where the light intensity distribution control means including the converging lens (i.e., an arrangement in which the excitation light source, the converging lens, and the light emitting material are placed on a straight line) cannot be carried out due to a limitation of layout, the light emitting device reflects the parallel light on the concave mirror. As described above, a device layout having high flexibility can be accomplished.

Further, in the light emitting device according to the present invention, the excitation light source includes a plurality of excitation light sources, and the light intensity distribution control means includes a plurality of convex lenses and a plurality of concave mirrors, which are respectively provided to the plurality of excitation light sources, each convex lens converting excitation light into parallel light, and each concave mirror receiving, from a corresponding convex lens, the parallel light as incident light, and reflecting the light toward one focal point.

Further, the light emitting device according to the present invention may be arranged such that the plurality of excitation light sources are provided respectively with the convex lenses and the concave mirrors, and therefore light intensity distribution can be easily formed on the basis of the focal point of the excitation light reflected on the concave mirrors. By changing the concave lenses to be used, the light intensity distribution can be easily changed or/and controlled on the basis of the differences of the optical characteristics.

Further, in the case where the light intensity distribution control means including the converging lenses (i.e., an arrangement in which the excitation light source, the converging lens, and the light emitting material are placed on a straight line) cannot be carried out due to a limitation of layout, the light emitting device reflects the parallel light on the concave mirror. As described above, a device layout having high flexibility can be accomplished.

As described above, the light intensity distribution control means can be accomplished in various ways. That is, an arrangement of the light intensity distribution control means can be determined in accordance with a size, a shape, etc. of the light emitting device. This can improve a freedom of design of the light emitting device.

Further, in the light emitting device according to the present invention, the light-projecting section is preferably a reflection mirror for reflecting the fluorescence emitted from the light emitting section.

Further, in the light emitting device according to the present invention, the light-projecting section is preferably a convex lens for changing angles of rays of the fluorescence emitted from the light emitting section.

According to this arrangement, the light-projection of the fluorescence emitted from the light emitting section toward the outside of the light emitting device can be accomplished in various ways. Therefore, the reflection mirror and the convex lens may be selected in accordance with various factors such as a use for or a designing condition of the light emitting device, or the other factor. Hence, the light emitting device having high freedom of design can be provided to a user.

Further, in the light emitting device according to the present invention, a convex lens for converging the excitation light; and a cylindrical lens for guiding the excitation light to the light emitting section by changing, along only one direction, angles of rays of the excitation light transmitted through the convex lens.

Further, in the light emitting device according to the present invention, an ellipsoid convex lens that guides the excitation light to the light emitting section by causing the excitation light to transmit through the ellipsoid convex lens.

The light emitting device according to the present invention can be used for various uses. The light emitting device according to the present invention is so highly versatile that it can be used as suitable in the various uses.

For example, assume that the case where the light emitting device according to the present invention is used in a vehicle headlamp. The vehicle headlamp is required to efficiently illuminate a center of a road, sidewalks on both sides, road signs, etc. Therefore a light-projection pattern is preferably formed not into a circle but into an ellipse having an ellipsoidal shape long across a driving direction of the vehicle.

At this point, the light emitting device according to the present invention can accomplish a light-projection pattern having the ellipse having the ellipsoidal shape long across a driving direction of the vehicle by including this arrangement. With this, when the light emitting device according to the present invention is used in a vehicle headlamp, the light emitting device can efficiently illuminate a center of a road, sidewalks on both sides, road signs, etc. Further, in the case where the light emitting device according to the present invention is used in devices other than the vehicle headlamp, specifications of the convex lens and cylindrical lens can be appropriately changed. In this way, the light emitting device can be flexibly changed in accordance with a use for the light emitting device.

Further, in the light emitting device according to the present invention, the reflection mirror may include at least a part of a partially curved-surface which has a shape obtainable by cutting off a curved shape formed by rotating a parabola about a symmetric axis of the parabola as a rotation axis, the cutting off being cutting along a plane including the rotation axis.

At least a part of the reflection mirror is paraboloid, and hence fluorescence from the light emitting section can be efficiently projected within a predetermined solid angle. This can improve use efficiency of fluorescence.

In the case where a half of the reflection mirror is a parabolic mirror and the other half thereof is a structure other than paraboloid (e.g., reflection plate) for example, a range in which uncontrollable stray light of fluorescence reflected on the reflection mirror is projected is different between a parabolic side of the reflection mirror and the other side thereof. Specifically, the range in which the uncontrollable stray light is projected is larger on the parabolic side of the reflection mirror than on the other side. Therefore, by using this feature, a wide range on the parabolic side of the reflection mirror can be appropriately illuminated.

With this, the light emitting device according to the present invention can accomplish more various light-projection patterns in accordance with its usage state.

Note that, in the aforementioned arrangement, the light-projection pattern can be changed in accordance with the thickness of the light emitting section in a direction perpendicular to the irradiation surface. Specifically, thickening the thickness of the light emitting section can provide a more circle light-projection pattern, and thinning a thickness of the light emitting section can provide a more ellipsoid-shaped light-projection pattern.

Further, in the light emitting device according to the present invention, the reflection mirror may include at least a part of a curved surface formed by rotating a circle, ellipse, or parabola about a symmetric axis of the circle, ellipse, or parabola, which axis is served as a rotation axis.

The aforementioned arrangement has an effect that the reflection mirror can be controlled easily by the shape of the light emitting section, rather than by thickness of the light emitting section. For example, when a ellipsoid-shaped fluorescent material (i.e., a fluorescent material having a wide-width irradiation surface) is used, a light-projection pattern having a shape extending in the horizontal direction can be accomplished.

Further, a vehicle headlamp may include any one of the light emitting devices.

Further, an illumination device may include any one of the light emitting devices.

The light emitting device according to the present invention is suitably used in a vehicle headlamp, illumination device, etc. In the case where the light emitting device according to the present invention is used in a vehicle headlamp for example, the vehicle headlamp can provide an arbitrary light-projection pattern in accordance with a driving state of a vehicle, and therefore the light emitting device can be much convenient for a user.

Further, a vehicle includes a vehicle headlamp, the vehicle headlamp including: an excitation light source for emitting excitation light; a light emitting section for emitting fluorescence by receiving the excitation light emitted from the excitation light source; a reflection mirror having a reflecting curved-surface for reflecting the fluorescence emitted from the light emitting section; and a support having a surface that faces the reflecting curved-surface, the support supporting the light emitting section, the vehicle headlamp being provided in the vehicle so that the reflecting curved-surface is positioned on a lower side of the headlamp in the vertical direction.

In a state in which the vehicle headlamp is provided in a vehicle, the reflection mirror having the reflecting curved-surface is positioned on the lower side of the vehicle headlamp in the vertical direction and the support is positioned on the upper side thereof in the vertical direction, and hence fluorescence which has been emitted from the light emitting section and could not have been controlled by the reflection mirror is projected more on a side of the reflection mirror of the vehicle headlamp, i.e., the lower side of the vehicle headlamp in the vertical direction. Therefore the vehicle headlamp can illuminate far (due forward direction of vehicle) with light controlled by the reflection mirror, and in addition, can illuminate the vicinity of and downward the vehicle with the fluorescence which could not have been controlled by the reflection mirror. Accordingly the fluorescence which could not have been controlled by the reflection mirror can be used effectively, and the vehicle headlamp can extend an illumination range of the vehicle headlamp while brightly illuminating the due forward direction of the vehicle.

Further, as described above, a vehicle according to the present invention includes a vehicle headlamp, the vehicle headlamp including: an excitation light source for emitting excitation light; a light emitting section for emitting fluorescence by receiving the excitation light emitted from the excitation light source; a reflection mirror having a reflecting curved-surface for reflecting the fluorescence emitted from the light emitting section; and a support having a surface that faces the reflecting curved-surface, the support supporting the light emitting section, the vehicle headlamp being provided in the vehicle so that the reflecting curved-surface is positioned on a lower side of the vehicle headlamp in the vertical direction.

INDUSTRIAL APPLICABILITY

The present invention relates to a light emitting device, and, in particular, can be used in a vehicle headlamp, and an illumination device, each of which can accomplish an arbitrary light-projection pattern.

REFERENCE SIGNS LIST

1, 21, 22, 23, 24, 101 headlamp
2, 102 laser element
3 lens
4, 104 light emitting section
5, 105 parabolic mirror
5*b* opening
6 window section
7, 107 metal base
10 automobile (vehicle)
11, 111 converging lens
12 optical fiber
14 reflection mirror
35, 135 laser beam source unit
51 circular parabolic mirror
51*a* opening
55 glass plate
60 compound lens (light intensity distribution control means)
61, 62, 63, 65, 66 converging lens (light intensity distribution control means)
64 aperture (light intensity distribution control means)
67, 67*a*, 67*b* convex lens (light intensity distribution control means)
68, 69, 69*a*, 69*b* concave mirror (light intensity distribution control means)
108 convex lens
109 glass plate
110 cylindrical lens
111 converging lens (convex lens)
A, B region
P, P1, P2 position
Q, Q1, Q2 converging point

The invention claimed is:

1. A light emitting device, comprising:

an excitation light source for emitting excitation light;

a light emitting section for emitting fluorescence by receiving the excitation light emitted from the excitation light source; and a light-projecting section for projecting the fluorescence emitted from the light emitting section, the light emitting section being placed so that a focal point of the light-projecting section and a periphery of the focal point are positioned on the light emitting section, the light emitting section being most strongly excited at a portion corresponding to the focal point, meanwhile, at a portion corresponding to the periphery of the focal point, the light emitting section being excited with intensity being dependent on light intensity distribution of the excitation light on an irradiation surface of the light emitting section.

2. The light emitting device according to claim 1, wherein the light intensity distribution of the excitation light is controlled to control a light-projection pattern of light emitted from the light emitting device.

3. The light emitting device according to claim 1, wherein, in the light intensity distribution of the excitation light, light intensity on the portion corresponding to the focal point is the highest, and light intensity on the portion corresponding to the periphery of the focal point is lower than the light intensity on the portion corresponding to the focal point.

4. The light emitting device according to claim 1, wherein, the light intensity distribution of the excitation light is wider in a first direction than in a second direction, where the first direction and the second direction are directions defined on the irradiation surface, and the second direction is vertical to the first direction.

5. The light emitting device according to claim 4, wherein the light intensity distribution is wider in the first direction than in the second direction by three times or more.

6. The light emitting device according to claim 1, further comprising light intensity distribution control means for controlling the light intensity distribution of the excitation light emitted from the excitation light source.

7. The light emitting device according to claim 6, wherein the light intensity distribution control means includes a plurality of lens having respective different optical characteristics.

8. The light emitting device according to claim 6, wherein the light intensity distribution control means includes: a converging lens that causes the excitation light emitted from the excitation light source to converge upon the light emitting section; and an aperture that provides different light transmittances to different paths of the excitation light passed through the converging lens.

9. The light emitting device according to claim 6, wherein the excitation light source includes a plurality of excitation light sources, the light intensity control means includes a plurality of converging lenses provided respectively to the plurality of excitation light sources, so that each converging lens causes excitation light emitted from a corresponding one of the plurality of excitation light sources to converge upon the light emitting section.

10. The light emitting device according to claim 6, wherein the light intensity distribution control means includes: a convex lens for converting the excitation light of the excitation light source into parallel light; and a concave mirror for receiving the parallel light as incident light and reflecting the incident light toward two focal points.

11. The light emitting device according to claim 6, wherein the light intensity distribution control means includes: a convex lens for converting the excitation light of the excitation light source into parallel light; a concave mirror for receiving the parallel light as incident light and reflecting the incident light toward one focal point; and an aperture that provides different light transmittances to different paths of the light reflected on the concave mirror.

12. The light emitting device according to claim 6, wherein the excitation light source includes a plurality of excitation light sources, and the light intensity distribution control means includes a plurality of convex lenses and a plurality of concave mirrors, which are respectively provided to the plurality of excitation light sources, each convex lens converting excitation light into parallel light, and each concave mirror receiving, from a corresponding convex lens, the parallel light as incident light, and reflecting the light toward one focal point.

13. The light emitting device according to claim 1, wherein the light-projecting section is a reflection mirror for reflecting the fluorescence emitted from the light emitting section.

14. The light emitting device according to claim 1, wherein the light-projecting section is a convex lens for changing angles of rays of the fluorescence emitted from the light emitting section.

15. The light emitting device according to claim 1, further comprising:

a convex lens for converging the excitation light; and a cylindrical lens for guiding the excitation light to the light emitting section by changing, along only one direction, angles of rays of the excitation light transmitted through the convex lens.

16. The light emitting device according to claim 1, further comprising an ellipsoid convex lens that guides the excitation light to the light emitting section by causing the excitation light to transmit through the ellipsoid convex lens.

17. The light emitting device according to claim 13, wherein the reflection mirror includes at least a part of a partially curved-surface which has a shape obtainable by cutting off a curved shape formed by rotating a parabola about a symmetric axis of the parabola as a rotation axis, the cutting off being cutting along a plane including the rotation axis.

18. The light emitting device according to claim 13, wherein the reflection mirror includes at least a part of a curved surface formed by rotating a circle, ellipse, or parabola about a symmetric axis of the circle, ellipse, or parabola, which axis is served as a rotation axis.

19. A vehicle headlamp comprising a light emitting device according to claim 1.

20. An illumination device comprising a light emitting device according to claim 1.

* * * * *